US009000918B1

(12) United States Patent
McLaughlin et al.

(10) Patent No.: US 9,000,918 B1
(45) Date of Patent: Apr. 7, 2015

(54) SECURITY BARRIERS WITH AUTOMATED RECONNAISSANCE

(71) Applicants: James O. McLaughlin, Mount Prospect, IL (US); Adam D. Baird, Salisbury, NC (US); Barclay J. Tullis, Palo Alto, CA (US); Roger Allen Nolte, Concord, NC (US)

(72) Inventors: James O. McLaughlin, Mount Prospect, IL (US); Adam D. Baird, Salisbury, NC (US); Barclay J. Tullis, Palo Alto, CA (US); Roger Allen Nolte, Concord, NC (US)

(73) Assignee: Kontek Industries, Inc., Kannapolis, NC (US)

( * ) Notice: Subject to any disclaimer, the term of this patent is extended or adjusted under 35 U.S.C. 154(b) by 219 days.

(21) Appl. No.: 13/783,267

(22) Filed: Mar. 2, 2013

(51) Int. Cl.
*G08B 13/00* (2006.01)
*G08B 13/12* (2006.01)

(52) U.S. Cl.
CPC ..... *G08B 13/122* (2013.01); *G08B 13/12* (2013.01)

(58) Field of Classification Search
CPC ..... G08B 13/122; G08B 13/12; G08B 13/00
USPC ..... 340/541
See application file for complete search history.

(56) References Cited

U.S. PATENT DOCUMENTS

| | | | |
|---|---|---|---|
| 4,287,511 | A | 9/1981 | Scott et al. |
| 5,091,780 | A | 2/1992 | Pomerleau |
| 5,228,113 | A | 7/1993 | Shelton |
| 5,517,429 | A | 5/1996 | Harrison |
| 6,016,384 | A | 1/2000 | Gallo |
| 6,392,536 | B1 | 5/2002 | Tice et al. |
| 6,728,690 | B1 | 4/2004 | Meek et al. |
| 7,017,186 | B2 | 3/2006 | Day |
| 7,144,187 | B1 | 12/2006 | Nolte et al. |
| 7,170,418 | B2 | 1/2007 | Rose-Pehrsson et al. |
| 7,595,815 | B2 | 9/2009 | Donovan |
| 7,654,768 | B1 | 2/2010 | Tullis et al. |
| 7,661,228 | B1 | 2/2010 | Nolte et al. |
| 7,847,688 | B2 | 12/2010 | Bernard et al. |
| 7,961,094 | B2 | 6/2011 | Breed |
| 8,077,036 | B2 | 12/2011 | Berger et al. |
| 8,111,174 | B2 | 2/2012 | Berger et al. |
| 8,210,767 | B1 * | 7/2012 | Swahlan et al. ..... 404/6 |

(Continued)

OTHER PUBLICATIONS

Pending U.S. Appl. No. 12/877,670, filed Sep. 8, 2010 by Charles Merrill, Kevin Charles Kriegel, Allen Roger Nolte, Barclay J. Tullis and titled "Security Systems Having Communication Paths in Tunnels of Barrier Modules and Armored Building Modules".

(Continued)

*Primary Examiner* — Kerri McNally
(74) *Attorney, Agent, or Firm* — Barclay J. Tullis

(57) ABSTRACT

An intrusion delaying barrier includes primary and secondary physical structures and can be instrumented with multiple sensors incorporated into an electronic monitoring and alarm system. Such an instrumented intrusion delaying barrier may be used as a perimeter intrusion defense and assessment system (PIDAS). Problems with not providing effective delay to breaches by intentional intruders and/or terrorists who would otherwise evade detection are solved by attaching the secondary structures to the primary structure, and attaching at least some of the sensors to the secondary structures. By having multiple sensors of various types physically interconnected serves to enable sensors on different parts of the overall structure to respond to common disturbances and thereby provide effective corroboration that a disturbance is not merely a nuisance or false alarm. Use of a machine learning network such as a neural network exploits such corroboration.

21 Claims, 13 Drawing Sheets

(56) References Cited

U.S. PATENT DOCUMENTS

| | | | | |
|---|---|---|---|---|
| 8,253,563 | B2 | 8/2012 | Burnard et al. | |
| 8,384,542 | B1 * | 2/2013 | Merrill et al. | 340/541 |
| 2014/0139337 | A1 * | 5/2014 | Piper et al. | 340/541 |

OTHER PUBLICATIONS

Pending U.S. Appl. No. 12/877,728, filed Sep. 8, 2010 by Charles Merrill, Kevin Charles Kriegel, Allen Roger Nolte, Barclay J. Tullis and titled "Security Systems with Adaptive Subsystems Networked through Barrier Modules and Armored Building Modules".

Pending U.S. Appl. No. 12/877,754, filed Sep. 8, 2010 by Charles Merrill, Kevin Charles Kriegel, Allen Roger Nolte, Barclay J. Tullis and titled "Diversity Networks and Methods for Secure Communications".

Pending U.S. Appl. No. 12/877,816, filed Sep. 8, 2010 by Charles Merrill, Kevin Charles Kriegel, Allen Roger Nolte, Barclay J. Tullis and titled "Global Positioning Systems and Methods for Asset and Infrastructure Protection".

"A Low Cost Fence Impact Classification System with Neural Networks" by J. de Vries in the 7th IEEE Africon Conference in Africa, Sep. 17, 2004, vol. 1, pp. 131-136.

"The Dependence of Detection System Performance on Fence Construction and Detector Location" by Tarr S. and Leach G., 1998 IEEE 32nd Annual 1998 International Carnahan Conference on Security Technology, pp. 196-200.

* cited by examiner

550

Error Cost Function:

$$J(\theta)=-\frac{1}{M}\left[\sum_{m=1}^{M}\sum_{k=1}^{K}\left(y_k^{(m)}\log_\theta h_\theta(x^{(m)})_k+(1-y_k^{(m)})\log_\theta(1-h_\theta(x^{(m)})_k)\right)\right]+$$

$$\frac{\lambda}{2M}\sum_{l=1}^{L-1}\sum_{i=1}^{S_{l+1}}\sum_{j=1}^{S_l}(\theta_{ij}^{(l)})^2$$

600

$$\begin{pmatrix} z_1^{\,2} \\ z_2^{\,2} \\ z_3^{\,2} \\ z_4^{\,2} \end{pmatrix} = \begin{pmatrix} \theta^{(1)}_{10} & \theta^{(1)}_{20} & \theta^{(1)}_{30} & \theta^{(1)}_{40} \\ \theta^{(1)}_{11} & \theta^{(1)}_{21} & \theta^{(1)}_{31} & \theta^{(1)}_{41} \\ \theta^{(1)}_{12} & \theta^{(1)}_{22} & \theta^{(1)}_{32} & \theta^{(1)}_{42} \\ \theta^{(1)}_{13} & \theta^{(1)}_{23} & \theta^{(1)}_{33} & \theta^{(1)}_{43} \\ \theta^{(1)}_{14} & \theta^{(1)}_{24} & \theta^{(1)}_{34} & \theta^{(1)}_{44} \\ \theta^{(1)}_{15} & \theta^{(1)}_{25} & \theta^{(1)}_{35} & \theta^{(1)}_{45} \end{pmatrix}^{T} \begin{pmatrix} x_0 \\ x_1 \\ x_2 \\ x_3 \\ x_4 \\ x_5 \end{pmatrix}$$

610

$$\begin{pmatrix} z_1^{\,3} \\ z_2^{\,3} \\ z_3^{\,3} \\ z_4^{\,3} \end{pmatrix} = \begin{pmatrix} \theta^{(2)}_{10} & \theta^{(2)}_{20} & \theta^{(2)}_{30} & \theta^{(2)}_{40} \\ \theta^{(2)}_{11} & \theta^{(2)}_{21} & \theta^{(2)}_{31} & \theta^{(2)}_{41} \\ \theta^{(2)}_{12} & \theta^{(2)}_{22} & \theta^{(2)}_{32} & \theta^{(2)}_{42} \\ \theta^{(2)}_{13} & \theta^{(2)}_{23} & \theta^{(2)}_{33} & \theta^{(2)}_{43} \\ \theta^{(2)}_{14} & \theta^{(2)}_{24} & \theta^{(2)}_{34} & \theta^{(2)}_{44} \end{pmatrix}^{T} \begin{pmatrix} a_0^{\,2} \\ a_1^{\,2} \\ a_2^{\,2} \\ a_3^{\,2} \\ a_4^{\,2} \end{pmatrix}$$

620

$$\begin{pmatrix} z_1^{\,4} \\ z_2^{\,4} \\ \\ \\ \end{pmatrix} = \begin{pmatrix} \theta^{(3)}_{10} & \theta^{(3)}_{20} \\ \theta^{(3)}_{11} & \theta^{(3)}_{21} \\ \theta^{(3)}_{12} & \theta^{(3)}_{22} \\ \theta^{(3)}_{13} & \theta^{(3)}_{23} \\ \theta^{(3)}_{14} & \theta^{(3)}_{24} \end{pmatrix}^{T} \begin{pmatrix} a_0^{\,3} \\ a_1^{\,3} \\ a_2^{\,3} \\ a_3^{\,3} \\ a_4^{\,3} \end{pmatrix}$$

FIG. 15

700

Formulae useful for Back Propagation:

$$\frac{\partial}{\partial \theta_{ij}^{(l)}} J(\theta) = \frac{1}{M} \Delta_{ij}^{(l)} + \lambda \theta_{ij}^{(l)} \text{ if } j \neq 0$$

$$\frac{\partial}{\partial \theta_{ij}^{(l)}} J(\theta) = \frac{1}{M} \Delta_{ij}^{(l)} \text{ if } j = 0$$

where $\Delta_{ij}^{(l)} = \sum_{m=1}^{M} a_{jm}^{(l)} \delta_{im}^{(l+1)}$ and where $\delta_{im}^{(L)} = a_{im}^{(4)} - y_{im}$ and for $l = 2, 3, \ldots, L$ : $\delta_{im}^{(l)} = [\sum_{j=1}^{S_{l+1}} (\theta_{ij}^{(l)} \delta_{jm}^{(l+1)})][a_{im}^{(l)}(1 - a_{im}^{(l)})]$

FIG. 16

SECURITY BARRIERS WITH AUTOMATED RECONNAISSANCE

STATEMENT REGARDING FEDERALLY SPONSORED RESEARCH OR DEVELOPMENT

This invention was made under a CRADA (SC10/01775.00) between Kontek Industries, Inc. (along with its subsidiary, Stonewater Control Systems, Inc.) and Sandia National Laboratories, operated for the United States Department of Energy. The government has certain rights in this invention.

CROSS-REFERENCE TO RELATED APPLICATIONS

This application relates to five and co-owned Non-provisional patent applications filed simultaneously to one-another on Sep. 8, 2010 as follows: 1) titled "Security Systems Having Communication Paths in Tunnels of Barrier Modules and Armored Building Modules", application Ser. No. 12/877,670; 2) titled "Security Systems with Adaptive Subsystems Networked through Barrier Modules and Armored Building Modules", application Ser. No. 12/877,728; 3) titled "Diversity Networks and Methods for Secure Communications", application Ser. No. 12/877,754; 4) titled "Autonomous and Federated Sensory Subsystems and Networks for Security Systems", application Ser. No. 12/877,794; and 5) titled "Global Positioning Systems and Methods for Asset and Infrastructure Protection", application Ser. No. 12/877,816; the disclosures of which are hereby incorporated by reference in their entireties.

THE NAMES OF THE PARTIES TO A JOINT RESEARCH AGREEMENT

This invention was made under a CRADA (SC10/01775.00) between Kontek Industries, Inc. (along with its subsidiary, Stonewater Control Systems, Inc.) and Sandia National Laboratories, operated for the United States Department of Energy.

INCORPORATION-BY-REFERENCE OF MATERIAL SUBMITTED ON A COMPACT DISC

Not Applicable

BACKGROUND OF THE INVENTION

1. Field of the Invention

The present invention relates generally to physical barriers placed along a perimeter of a security area for the purpose of thwarting or at least delaying unwanted intrusions. The barriers may be combined with sensors to enable electronic security systems and methods to automatically and reliably monitor the perimeter for intruders or terrorist threats.

2. Description of the Related Art

Security zones for protecting groups of people and/or facilities be they private, public, diplomatic, military, industrial, or other zones, can be dangerous environments for people and property if threatened by intruders. The prior art in security systems and armored protection provide some solutions but fall far short of being synergistically integrated and are often are too costly and require intense human oversight. Solutions that include the use of sensors have been limited by lower than desirable probability of detection of intrusion attempts, by higher than desirable nuisance alarm rates (NAR), and by higher than desirable false alarm rates (FAR).

In the prior art, automated monitoring and control systems sense disturbances to an ambient condition and cause alarms to be activated, but these systems fall short of being able to adequately identify many relevant cause(s) of a disturbance, and they are not usually applied to detecting attempts at physical intrusion through a physical barrier. U.S. Patent Application Publication No. 2006/0031934 by Kevin Kriegel titled "Monitoring System", incorporated herein by reference in its entirety, discloses a system that monitors and controls devices that may sense and report a location's physical characteristics through a distributed network. Based on sensed characteristics, the system may determine and/or change a security level at a location. The system may include a sensor, an access device, and a data center. The sensor detects or measures a condition at a location. The access device communicates with the sensor and the data center. The data center communicates with devices in the system, manages data received from the access device, and may transmit data to the access device. However this discloses nothing to provide a physical barrier against intruders accessing the devices that are to be monitored.

Rows of concrete barrier blocks that can slide across the ground can stop and destroy terrorist vehicles that collide with them, and can protect against blast waves and blast debris, but they offer no earlier warning signals of threats. U.S. Pat. No. 7,144,186 to Roger Allen Nolte titled "Massive Security Barrier", U.S. Pat. No. 7,144,187 to Roger Allen Nolte and Barclay J. Tullis titled "Cabled Massive Security Barrier", U.S. Pat. No. 7,654,768 to Barclay J. Tullis, Roger Allen Nolte, and Charles Merrill titled "Massive Security Barriers Having Tie-Bars in Tunnels", and U.S. Pat. No. 8,061,930 to Barclay J. Tullis, Roger Allen Nolte, and Charles Merrill titled "Method of Protection with Massive Security Barriers Having Tie-Bars in Tunnels" all incorporated herein by reference in their entireties, disclose barrier blocks or modules, and barriers constructed of barrier modules. U.S. Pat. No. 7,144,186 discloses barrier modules, each with at least one rectangular tie-bar of steel cast permanently within concrete (or other solid material) and extending longitudinally between opposite sides of the barrier module, wherein adjacent barrier modules are coupled side-against-side by means of strong coupling devices between adjacent tie-bars, and wherein no ground penetrating anchoring means is involved. But since the tie-bars are cast within the barrier modules, they cannot be changed out or upgraded without removing and replacing the solid material as well. However, U.S. Pat. No. 7,144,187 discloses barrier modules of solid material with tunnels extending between opposite sides, wherein adjacent barrier modules are coupled side-against-side with cables passing through the tunnels and anchored to sides of at least some of the barrier modules by anchoring devices. And U.S. Pat. No. 7,654,768 discloses barrier modules that have tie-bars in tunnels that extend longitudinally between opposite sides of a barrier module. U.S. Pat. No. 8,061,930 discloses methods for providing protection from a terrorist threat by using the above barrier modules that have tie-bars in tunnels. Whereas barriers of concrete blocks provide impressive protection against breeches by vehicles and explosives, they provide alone little to prevent humans from climbing over them.

U.S. Pat. No. 8,210,767 to David J. Swahlan and Jason Wilke titled, "Vehicle Barrier with Access Delay" discloses an access delay vehicle barrier for stopping unauthorized entry into secure areas by a vehicle ramming attack. The barrier disclosed includes access delay features for preventing and/or delaying an adversary from defeating or compromising the barrier. A horizontally deployed barrier member can include an exterior steel casing, an interior steel reinforcing member and access delay members disposed within the casing and between the casing and the interior reinforcing member. Access delay members can include wooden structural lumber, concrete and/or polymeric members that in combination with the exterior casing and interior reinforcing member act cooperatively to impair an adversarial attach by thermal, mechanical and/or explosive tools. However, this solution alone does little to prevent humans from easily climbing over or under its structure.

In a paper titled, "A low cost fence impact classification system with neural networks" by J. de Vries in the 7th AFRICON Conference in Africa, 17 Sep. 2004, Vol. 1, pp. 131-136, a system is proposed for securing property to prevent livestock theft and farm intrusions. The paper reports a system that analyzes vibrations sensed by a point sensor to detect intrusions past a game farm or security fence, and since the point sensor can detect vibrations generated at a distance from the sensor, owners of protected property can receive early warnings. Different types of intrusions can be distinguished if they generate different vibrations. But use is made of only one type of sensor, a point vibration sensor on each horizontal wire of a wire fence. Avoiding challenges of dealing with signals varying in amplitude and duration caused by variation in distances of fence disturbances from a sensor, the author chose to use cross-correlations to detect events on wires and then input those events as ones into a feature set defined by wire number and time slots.

In the 2004 Proceedings of the 37th Hawaii International Conference on System Sciences, a paper titled, "Intrusion Sensor Data Fusion in an Intelligent Intrusion Detection System Architecture", by Ambareen Siraj, Rayford B. Vaughn, and Susan M. Bridges, the authors state, "most modern intrusion detection systems employ multiple intrusion sensors to maximize their trustworthiness." They also say, "The overall security view of the multisensory intrusion detection system can serve as an aid to appraise the trustworthiness in the system." Their paper presents their research effort in that direction by describing a Decision Engine for an Intelligent Intrusion Detection System (IIDS) that fuses information from different intrusion detection sensors using an artificial intelligence technique. The Decision Engine uses Fuzzy Cognitive Maps (FCMs) and fuzzy rule-bases for causal knowledge acquisition and to support the causal knowledge reasoning process. However, their paper deals only with detecting intrusions into electronic communication traffic and does not anticipate utilizing interactions of sensors with elements of a physical barrier structure, and it does not disclose use of sensors that corroborate one another in a complementary way by virtue of being physically connected to a common structure experiencing a disturbance.

U.S. Pat. No. 5,091,780 by Pomerleau titled, "A trainable security system and method for the same", discloses a security system comprising a processing device for monitoring an area under surveillance by processes images of the area to determine whether the area is in a desired state or an undesired state. The processing device is said to be trainable to learn the difference between the desired state and the undesired state. The processing device includes a computer simulating a neural network. However, it is well known that image sensors use limited fields of view, and that neural nets operating on imaging data can be fooled by camouflaged intruders, very rapid changes, and a wide diversity of weather.

U.S. Pat. No. 5,517,429 by Harrison titled, "Intelligent area monitoring system", discloses an intelligent area monitoring system having a plurality of sensors, a neural network computer, a data communications network, and multiple graphic display stations. The neural network computer accepts the input signals from each sensor. It is asserted that any changes that occur within a monitored area are communicated to system users as symbols which appear in context of a graphic rendering of the monitored area to represent the identity and location of targets in the monitored area. The disclosed system attempts to identify objects by sensed attributes their locations, but is insufficient to detect or identify intrusive actions. Furthermore, "any changes" may include those scene changes responsible for what would desirably be categorized as nuisance alarms or even false alarms, and no such classification and identification is disclosed. The disclosed system doesn't comprise a physical security barrier nor is it combined with one, nor does it therefore exploit in any way the manner of mounting sensors to a common structure.

U.S. Pat. No. 8,253,563 by Burnard, et al. titled, "System and method for intrusion detection", discloses an invention that may be employed in intruder and vehicle alarm systems. The disclosure states, "Present day intrusion detection systems frequently cause false alarms by mistaking occupants as intruders, and it is desirable to reduce such false alarms." Their invention uses a processor that receives sensor signals over temporal periods and employs various software algorithms to statistically discern various activities, thereby attempting to reduce false alarms and detection failures. They state that the typical nature of activities is such that noise occurs frequently, normal activities occur less frequently, and abnormal activities occur least frequently. The algorithms apply logic statements to infer that information with a high probability of occurrence may be noise, information with a lower probability of occurrence may be normal activity, and information with the least probability of occurrence may be abnormal activity. Furthermore their system adjusts thresholds to obtain a predetermined false alarm rate. Something better is needed for a security barrier to reduce to a minimum both false alarm rates and nuisance alarm rates.

U.S. Pat. No. 8,077,036 by Berger et al. titled, "Systems and methods for security breach detection", discloses a system for detecting and classifying a security breach, one that may include at least one sensor configured to detect seismic vibration from a source, and to generate an output signal that represents the detected seismic vibration. The system may further include a controller that is configured to extract a feature vector from the output signal of the sensor and to measure one or more likelihoods of the extracted feature vector relative to set of breach classes. The controller may be further configured to classify the detected seismic vibration as a security breach belonging to one of the breach classes by choosing a breach class within the set that has a maximum likelihood. But not all breeches of a fence or other physical barrier can be detected by sensing only seismic vibrations.

U.S. Pat. No. 7,961,094 by Breed titled, "Perimeter monitoring techniques", discloses a method for monitoring borders or peripheries of installations and includes arranging sensors periodically along the border at least partially in the ground, the sensors being sensitive to vibrations, infrared radiation, sound or other disturbances, programming the sensors to wake-up upon detection of a predetermined condition and receive a signal, analyzing the signal and transmitting a signal indicative of the analysis with an identification or location of the sensors. The sensors may include a processor embodying a pattern recognition system trained to recognize characteristic signals indicating the passing of a person or vehicle. Whereas it is disclosed to apply pattern recognition techniques to each sensor individually, what is needed are more powerful techniques that apply pattern recognition techniques to a set of sensors as a whole, and in particular to a group of sensors of different types.

In a paper titled, "Machine Learning that Matters", by Kiri L. Wagstaff, published in the Proceedings of the Twenty-Ninth International Conference on Machine Learning (ICML), June 2012, it is stated that much of current machine learning (ML) research has lost its connection to problems of import to the larger world of science and society. What are needed are more applications of machine learning techniques to real-world applications such as improving the probabilities of detection of intruder or terrorist activities while minimizing false alarms rates and nuisance alarm rates.

BRIEF SUMMARY OF THE INVENTION

An intrusion delaying barrier is disclosed which includes primary and secondary physical structures and can be instrumented with multiple sensors incorporated into an electronic monitoring and alarm system. Such an instrumented intrusion delaying barrier may be used as a perimeter intrusion defense and assessment system (PIDAS). Problems with not providing effective delay to breaching by intentional intruders and/or terrorists who would otherwise evade detection are solved by attaching two or more of the secondary structures to the primary structure, and attaching at least some of the sensors to those secondary structures. By having multiple sensors of various types physically interconnected serves to enable sensors on different parts of the overall structure to respond to common disturbances and thereby provide effective corroboration that a disturbance is not merely a nuisance or false alarm. Use of a machine learning network such as a neural network exploits such corroboration.

Beyond providing improved physical protection, some example embodiments of the present invention(s) utilize the improved physical barriers along with a variety of sensors, machine-learning methods, apparatus, and systems to achieve physical barriers along with reconnaissance sensors and signal processing which, when compared with prior systems, enable increased probability of detection while reducing both nuisance alarms and false alarms. Examples of the types of areas or sites that can benefit from this kind of a self-monitoring barrier include military sites, embassies, nuclear sites, chemical facilities, communications facilities, and areas including personnel and/or strategically sensitive assets.

Prior art had not discovered the benefits and practicality of mounting a fence to a Normandy type barrier, or to a barrier comprising a row of concrete blocks tied together by a chain of steel bars. And prior art of combining security barriers with sensors had failed to more fully exploit synergistic integration of primary physical barrier structure with secondary structures used to mount selected sensors in a manner that utilizes the overall physical barrier structure to enhance the effectiveness of the sensors, or to utilize a variety of sensor types that can complement one another to reduce nuisance alarm rates (NAR) and false alarm rates (FAR).

The present inventions are pointed out with particularity in the appended claims. However, some embodiments and aspects of the inventions are summarized herein.

One embodiment of the inventions is an intrusion delaying barrier comprising 1) a primary structure selected from the group consisting of i) a steel beam supported by cross-bucks standing on top of the ground and ii) a row of concrete blocks sitting on top of the ground, wherein the row of concrete blocks is bound end-against-end by a chain of steel tie-bars; and 2) a secondary structure selected from the group consisting of a chain link fence, a welded mesh fence, and a wire fence; wherein a majority of weight of the secondary structure is supported by the primary structure; and wherein neither the primary structure nor the secondary structure is planted into the ground. This embodiment may include multiple sensors, multiple sensor support structures, an alarm status indicator, and a computer in communication with the multiple sensors and the alarm status indicator; wherein the computer may generates an output to the alarm status indicator when an intrusion attempt disturbs the barrier. The computer may be one that processes instructions simulating a first machine learning network that takes as inputs data from two or more of the multiple sensors. A second machine learning network may be included; wherein the intrusion delaying barrier may have a length axis that forms a dividing line between a more secure side and a less secure side; wherein the first and second machine learning networks may be connected to different groups of sensors of the multiple sensors; and wherein the first and second machine learning networks may monitor primarily their respective segments along the length dimension. The first machine learning network may include an artificial neural network. The alarm status indicator may be controlled by the computer to be an indicator of degree of correlation among at least two of the multiple sensors in sensing at least an intrusion attempt; and wherein the degree of correlation may be based on probabilities that disturbances to the sensors may be from an attempted intrusion. The first machine learning network may actively discriminate against nuisance conditions and/or against false alarm conditions. The multiple sensors may include at least three sensors that are each of a different type of sensor based on different transducer principles; wherein status of the alarm status indicator may be controlled by the computer to be a function of degree of correlation between at least two of the multiple sensors in sensing an intrusion attempt, and wherein the at least two of the multiple sensors are not of the same type of sensor. And the at least three sensors may be supported structurally by the barrier by respectively different mounting devices selected from the group consisting of a fence, a wire, a cable, a conduit, a tube, a bar, a pole, a wall, a cantilever, a panel, a bridge, a tower, and a horizontal channel. The steel beam supported by cross-bucks may be part of a Normandy type of barrier, or of a modified Normandy barrier such as disclosed in U.S. Pat. No. 8,210,767.

In another embodiment of the inventions, an intrusion delaying barrier comprises: 1) a contiguous series of interconnected steel beams that help to form a dividing line between a secure area of ground on one side of the beams and a less secure side on the other side of the beams; 2) multiple sensors; 3) multiple types of mechanical support structures each connecting one of the multiple sensors to the chain of interconnected steel beams; 4) an alarm status indicator; and 5) a computer in communication with both the multiple sensors and the alarm status indicator; wherein the multiple sensors include at least three different types of sensors based on different transducer principles; and wherein a status of the alarm status indicator is controlled by the computer to be a function of degree of correlation among at least two of the at least three different types of sensors in sensing at least an intrusion attempt. The steel beams of this embodiment may weigh at least fifteen kilograms per linear meter along the divide. The steel beams may be included in one selected from the group consisting of a Normandy type of barrier and a row of concrete blocks, wherein the blocks are bound together by the steel beams. The Normandy type of barrier may be a modified Normandy barrier such as disclosed in U.S. Pat. No. 8,210,767. At least one of the mechanical support structures may be connected to the steel beams and comprises one selected from the group consisting of a fence, a wire, a cable, a conduit, a tube, a bar, a pole, a wall, a cantilever, a panel, a bridge, a tower, and a horizontal channel. The degree of correlation may be based on probabilities that disturbances to the sensors are caused by attempted intrusion. The computer may include a machine learning network, which may include an artificial neural network, to which are fed data from the at least two of the at least three different types of sensors. And the machine learning network may actively discriminate against nuisance conditions and/or against false alarm conditions.

Yet another embodiment of the inventions may be a method of configuring a security barrier, the security barrier comprising both a physical barrier to delay or stop intruders and a system of sensors useful to detect intrusion attempts, the method comprising steps of: 1) installing the physical barrier; 2) installing the sensors to the physical barrier; 3) installing communication media for communication between the sensors and an alarm annunciator; 4) installing additional communication media for communication between at least one computer and two or more of the sensors; and 5) providing the at least one computer with instructions to execute a machine learning algorithm to transform sensor outputs into alarm outputs for the alarm annunciator; wherein no concrete or steel element of the physical barrier is buried in the ground. The method may further comprise the step of using the security barrier to delay or stop intruders, or at least detect intrusion attempts by would-be intruders.

Objects and Advantages of the Invention

Objects and advantages of the present invention include security barriers and security barrier systems that significantly out-perform those of the prior art, and at a lower cost per unit length. This is accomplished by merging together physical barrier structures of different types, and also by integrating these compound physical barriers with electronic security systems to exploit sensor interactions with structural components of the physical barrier. The objects and advantages are also to achieve security barriers that use sensors and artificial intelligence to improve probability of detecting and classifying attempts at intrusion and with a reduced false alarm rate and reduced nuisance alarm rate.

Further advantages of the present invention will become apparent to ones skilled in the art upon examination of the accompanying drawings and the following detailed description. It is intended that any additional advantages be incorporated herein.

The various features of the present invention and its preferred embodiments and implementations may also be better understood by referring to the accompanying drawings and the following detailed description. The contents of the following description and of the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion, and primes and double-prime suffixes are used to identify copies related to a particular embodiment, usage, and/or relative location. Within these drawings:

FIG. 4 shows overlapping beams and fields-of-view associated with photosensor components protecting the pass-through.

FIG. 15 shows more detail of the first of the two steps shown in FIG. 13 used in computations to simulate neuron activations.

FIG. 16 shows some of the computational steps used in an embodiment of backward propagation used to seek a minimum of the cost function shown in FIG. 14.

DETAILED DESCRIPTION OF THE INVENTION

Figure 1:
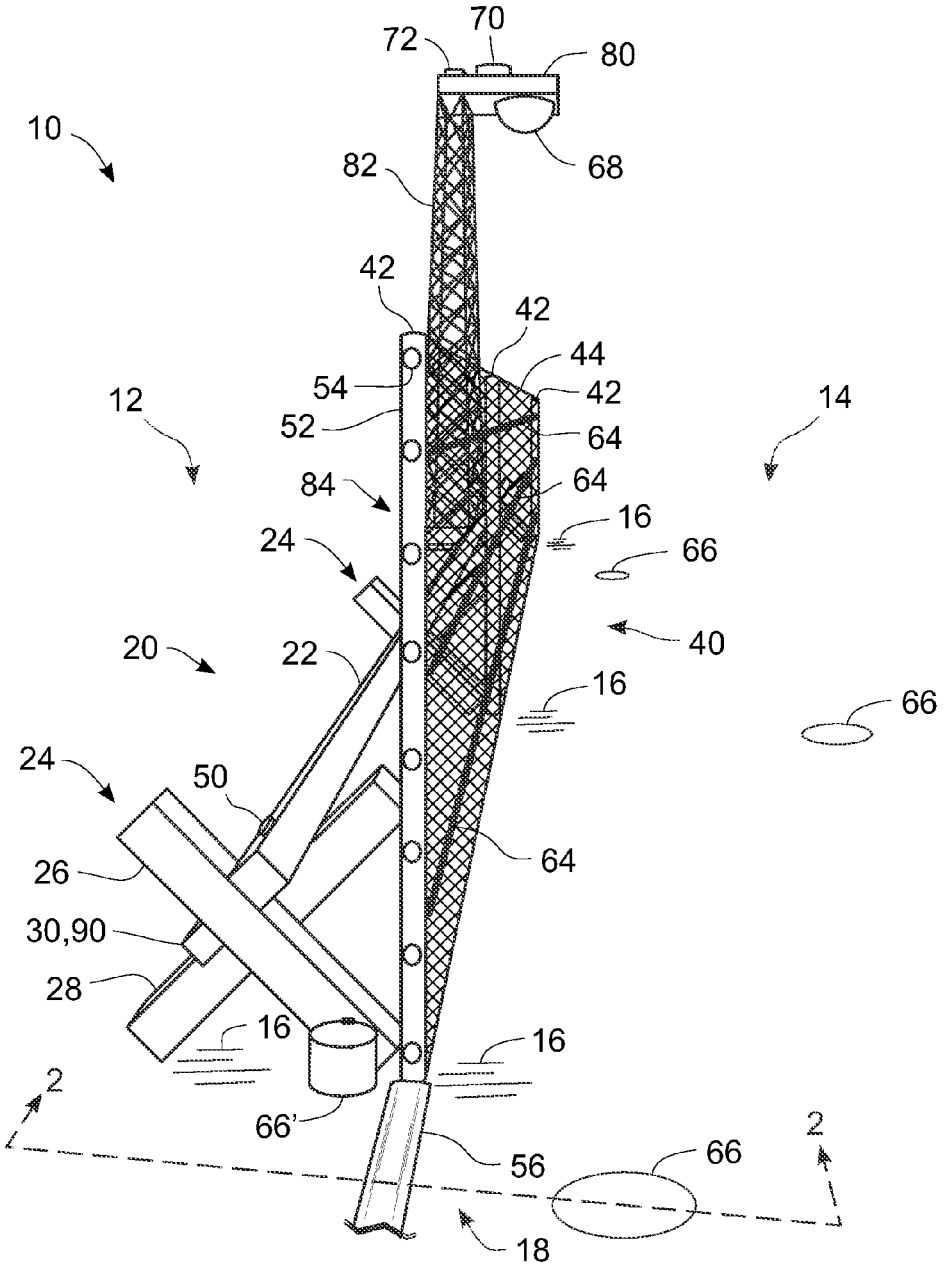
FIG. 1 shows a perspective view of a portion of one embodiment of an intrusion delaying barrier equipped with a variety of sensors and revealing one-half of a pass-through opening.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

While each sensor added to a perimeter may increase probability of intruder detection, each sensor added to a perimeter increases significantly the potential volume of nuisance and false alarms personnel must respond to, if traditional approaches are used in combining the information from the various sensors. The traditionally accepted practice for reducing nuisance and false alarms has been to tune down the sensitivity of particular sensors until an acceptable compromise is found between nuisance alarms and detection capability, thereby making a concession in favor of the intruder. Another traditional approach has been to use expert systems to make decisions based on logic in merging the output of two or more sensors to assess whether an event qualifies as an alarm. For example, methods which perform a logical AND on the alarm state output of separate sensors, effectively combine the weaknesses of the sensors as well as their strengths and result in probabilities of detection that are significantly lower than the sensors managed separately. These traditionally popular solutions can result in less capable systems that are not too difficult for an intruder to compromise. Exceptions exist when, for example, as when some sensors are known to be both highly sensitive and have very low nuisance and false alarm rates, and in such cases it can be desirable to use logic rules to combine their outputs with those of one or more learning machines that process the other sensors. Nevertheless, the current invention(s) provide(s) a better approach than using exclusively logical rules to combine sensor outputs.

The current invention(s) provide(s) the approach of combining sensor outputs in a way that increases overall probability of detection of intrusion attempts while simultaneously and dramatically reducing the incidence of false and nuisance alarms, with few poor tradeoffs. In order to accomplish this, richer data from the sensors than just threshold crossings are fed to a machine learning network such as a computer simulated artificial neural network or a probabilistic inference engine, and secondary structures are attached directly to the primary structure of the barrier in manners that enable sensors mounted to these structures to have increased ability to respond to disturbances of the barrier they wouldn't have otherwise.

Kontek Industries, Inc. and its subsidiary, Stonewater Control Systems, worked with Sandia National Laboratories on a shared project to build an alternative to a traditional PIDAS (perimeter intrusion detection and assessment system) that can offer improved security at a fraction of cost in time and money compared with the traditional systems. By furnishing a low-cost single line perimeter fence with multiple independent but complementary sensor technologies, they were able to achieve their goal of a lower cost physical barrier having automated reconnaissance to discourage or at least delay intrusion attempts by hostile vehicles and/or terrorist individuals. And by applying the current invention(s) to embodiments of that improved PIDAS, the project achieved also surprisingly good results in improved probability of detection and reduced rates of false and nuisance alarms.

A paper titled, "Design and Performance Testing of an Integrated Detection and Assessment Perimeter System", by Jeffrey G. Dabling, James O. McLaughlin, and Jason J. Andersen, in IEEE Paper No. ICCST-2012-28 presented 15-18 Oct. 2012 in Boston, Mass., discloses work and testing results performed under the above-mentioned project. The paper describes test results of the jointly developed and evaluated integrated perimeter security solution, one that couples access delay with detection and assessment. This novel perimeter solution was designed to be sufficiently flexible for implementation at a wide range of facility types, from high security military or government installations to commercial power plants, to industrial facilities of various kinds A prototype section of barrier was produced and installed at the Sandia Exterior Intrusion Sensor Testing Facility in Albuquerque, N. Mex. The prototype was implemented with a robust vehicle barrier and coupled with a variety of detection and assessment solutions to demonstrate both the effectiveness of such a solution, as well as the flexibility of the system. In this implementation, infrared sensors, a fiber-optic sensor, and fence disturbance sensors were coupled with a video motion detection sensor and seismic sensors. The ability of the system to properly detect pedestrian or vehicle attempts to bypass, breach, or otherwise defeat the system was demonstrated and characterized, as well as a reduced nuisance alarm rate. Products which may incorporate the current invention(s) will be marketed under the ReKon™ name.

DEFINITIONS

Within this disclosure and claims, "barrier" is defined to mean a physical structure intended to stop or delay passage across it, through it, or under it by intruders or otherwise hostile forces.

Within this disclosure and claims, "intruder" is defined to mean any person or vehicle that at least attempts to breech a barrier by going across it, through it, or under it, or attempts to damage the barrier.

Within this disclosure and claims, "Normandy type of barrier" is defined to mean any barrier that includes a structural main beam parallel to the ground surface and which is supported above the ground surface by cross-bucks. And, "modified Normandy barrier" will mean a Normandy type of barrier that has strengthening beams within the aforementioned structural main beam.

Within this disclosure and claims, "a disturbance" is defined to mean a physical response of a barrier (or of something attached to the barrier) resulting from an action by an intruder or an attempted intruder. The action can be induced by an intruder or attempted intruder and may be made directly or indirectly to the barrier and/or the surroundings or the barrier. One example of a disturbance would be a vibration induced in a barrier, or in something attached to the barrier, by an intruder climbing over the barrier. Another example would be a vehicle or person running or driving toward a barrier as sensed by a seismic sensor associated with the barrier.

Within this disclosure and claims, "transducer" is defined to mean that part of a sensor that transforms one form of energy to another and that responds to a change in physical, electrical, magnetic, electromagnetic, optical, acoustical, or chemical property or condition by effecting a change in an output value. Transducers types include, for example, capacitive, inductive, ultrasonic, electromagnetic (antenna, CCD, CMOS arrays), weight measuring, temperature, acceleration, chemical, sound or other types of sensing device.

Within this disclosure and claims, "sensor" is defined to mean a device or system that includes a transducer and changes a physical quantity or behavior into a signal for electronic processing.

Within this disclosure and claims, "discrimination" is defined to mean automated classification of an event or condition into at least one of two or more categories. The event or condition is generally sensed by one or more sensors.

Within this disclosure and claims, "pattern detection" and "pattern recognition" are defined to mean classification of one or more response signals (or sensor data) generated by one or more sensors (or sensor systems or subsystems) associated with a mechanical barrier intended to delay breeching by intrusive or otherwise hostile actions. These terms are furthermore defined to mean automated processing of data and/or signals from one or more sensors associated with a barrier to determine or classify the identity of an object, condition, event, or a combination thereof that has influenced or is influencing the sensor(s) (e.g. causing a disturbance).

Examples of such influences include acoustic vibrations; shaking or striking of barrier structure or sensors; cutting or heating of barrier structure or sensors; images of a barrier and/or its surroundings; weather; foot-steps; animal activity; vehicle-caused ground vibrations; vehicle-caused sounds; gases such as vehicle exhaust; structural vibrations; gunshots; explosions; object motions; object locations; electric fields; magnetic fields; electromagnetic waves (e.g.: visible light, infrared radiation, radar, electronic communications, and engineered activity of an electromagnetic nature at any frequency); and even their relationships to one-another. Pattern recognition may involve measurements of features, extraction of derived features as attributes, comparison with known patterns to determine a degree of correlation or of a match or mismatch, and/or determining system parameters that affect recognition. Pattern recognition may classify patterns in data and/or signals based on either a priori knowledge or on statistical information extracted from the patterns. The patterns to be classified are usually groups of measurements defining points in an appropriate multidimensional space.

Within this disclosure and claims, "machine learning system" and "machine learning network" are defined to mean one or more systems or apparatuses that are trained to automatically perform steps of pattern detection or pattern recognition. The classification scheme is usually based on the availability of a set of patterns that have already been classified or described. This set of patterns is termed the training set and the resulting learning strategy is characterized as supervised. Learning may also be unsupervised, in the sense that the system is not given an a priori labeling of patterns; instead unsupervised learning establishes the classes based on the statistical regularities of the patterns and without availability of a set of patterns that have already been classified or described. The classification scheme usually uses one of the following approaches: statistical (or decision theoretic), syntactic (or structural), or neural. Statistical pattern recognition is based on statistical characterizations of patterns, assuming that the patterns are generated by a probabilistic system. Structural pattern recognition is based on the structural interrelationships of features. Neural pattern recognition employs the neural computing paradigm that has emerged with artificial neural networks. Machine learning, for the most part, avoids explicit programming that requires logic rules based on knowledge of researchers and/or experts relative to the physical behavior of a barrier or of barrier intrusions. However, other algorithms can be used in addition, such as fuzzy logic, and/or sensor fusion that uses logic rules. The learning algorithm(s) used is/are stored and executed by a computer.

Within this disclosure and claims, "artificial neural network" (or simply "neural network") is defined to include all pattern learning algorithms (stored in a computer memory, or implemented as circuit hardware) including cellular neural networks, kernel-based learning systems having network structures, and cellular automata. A "combination neural network" as used herein will generally apply to any combination of two or more neural networks that are either connected together or that analyze all or a portion of the input data. A combination neural network can be used to divide up tasks in solving a particular pattern recognition problem. For example, one neural network can be used to classify as an alarm condition disturbance to a barrier caused by someone sawing an element of the barrier structure or its extensions, and a second neural network can be used to classify as a nuisance alarm condition an animal rubbing against a barrier. In another case, one neural network can be used merely to determine whether the sensor data is similar to that upon which a main neural network has been trained or whether there is something radically different about this data and therefore that the data should not simply be classified as an actionable alarm state. For the purposes of this disclosure and claims, an artificial neural network is a) constructed in hardware, b) emulated in software, or c) a combination of hardware construction and emulation software. Due to current state-of-the-art and its resultant limitations in availability of hardware architectures that can execute artificial neural network behavior (responses) in a truly distributed manner, most artificial neural networks today are emulated by running software in one or more serial processors. Much of the high-level programming is carried out using linear algebraic operations on matrices and vectors, and thereafter compiled or assembled to machine level code. A huge advantage of using artificial neural networks to classify patterns based on a large number of input features is the ability to classify the outputs of highly non-linear functions (behaviors) without having to compute regressions on high-order polynomials of those input features. Artificial neural networks typically use highly non-linear classification functions such as the logistic function (see FIG. 13 and its description below) to help sort patterns into categories each associated with a value of unity or zero, for example.

Within this disclosure and claims, "nuisance alarms" and "false alarms" are generally defined to mean alarms that are not indicators of true concern to those being protected by a barrier, which is to say that they do not accurately report true intrusions or attempts at intrusion by would-be intruders or other hostile actions to a barrier. More specifically, nuisance alarms are those that have resulted from some real effect but which are not desired as true alarms such as when an animal rubs against a barrier, or a sudden change in sunlight disturbs a photosensor. And also more specifically, false alarms are those that result from errors in classification or otherwise from errors in the functioning of sensors or other hardware or software.

Several embodiments of the current invention(s) and their aspects are described in some detail in the following paragraphs with reference to the figures.

FIG. 1 shows a perspective view of a portion of one embodiment of an intrusion delaying barrier 10 equipped with a variety of sensors 50, 52, 54, 56, 64, 66, 66', 68, 70, 72, and 90 and revealing one-half of a pass-through opening 18. The intrusion delaying barrier 10 divides an area of ground 16 in a protected area 12 from an area of ground 16 in an unprotected area 14. The physical structure part of the barrier 10 includes a Normandy type of barrier 20 which comprises a generally horizontal primary beam 22 supported off of the ground by cross-bucks 24 that are positioned at intervals along the major length of the primary beam 22. Each cross-buck comprises a pair of tilted beams: a back-leaning beam 26 and a forward leaning beam 28, where "backward" and "forward" are relative to one standing in the protected area 12 viewing outward toward the unprotected area 14. A generally horizontal secondary beam 30 is shown added parallel to the primary beam 22. For strength, the cross-bucks 24, primary beam 22, and secondary beam 30 are firmly attached to one another as by welding. The primary beam 22 and cross-bucks 24 can be configured as a Normandy type of barrier, or as a modified Normandy barrier as disclosed in U.S. Pat. No. 8,210,767 to David J. Swahlan and Jason Wilke. Additional beams (not shown) parallel to the primary beam 22 may also be attached to the cross-bucks and can be used for added strength as well as to protectively route sensor and other cabling (also not shown) along the barrier.

FIG. 1 also shows that the intrusion delaying barrier 10 includes a screen fence 40. The screen fence 40 of this embodiment comprises a screen 44 and support posts 40, wherein the support posts 40 are mounted to the cross-bucks 24 rather than being anchored into the ground 16. The screen 44 is mounted to the support posts 40. With such an above-ground configuration, the barrier 10 forms an integral unit of beam 22 and fence 40. This integration enables the fence 40 to remain attached to the cross-bucks 24 should a vehicle collide with the barrier 10 and move it across the ground's surface 16. In the embodiment shown, the fence 40 is a chain-link fence, however the screen fence 40 can be any of a variety of fence types including a chain-link fence, a mesh-screen fence, or even a simple farm fence comprised mostly of horizontal wires. In the embodiment shown, the fence 40 is a chain-link fence.

FIG. 1 also shows a number of sensors 50, 52, 54, 56, 64, 66, 66', 68, 70, 72, and 90. These are only examples of sensors, in type and/or number, which can be incorporated into embodiments of the current invention(s) of intrusion delaying barriers. Other embodiments of the current invention could use selections from any sensors that could, when used on or near an intrusion delaying barrier, output analog and/or digital signals in response to an attempted intrusion or to an actual intrusion of the barrier. One sensor is a vibration sensor 50 shown mounted directly to the primary beam 22. A second sensor is a photon bar sensor 52 that comprises a vertical array of photon sensors 54 comprising photon emitters and/or receivers. As FIG. 1 is a perspective view looking outward from within a pass-through opening 18 that passes through the barrier 10, only one side of the opening 18 is shown; therefore a complementary oppositely-facing photon bar sensor 52' on the opposite side of the opening 18 cannot be shown in this view. If there is nothing passing between the oppositely facing bars 52, some photons emitted from each photon emitter 54 on either of bars 52 or 52' will be received by respectively located photon detectors 54 on the respective bar 52' or 52. A third sensor is a bridge sensor 56 that is configured as a channel or plate on the ground 16 bridging the gap that is the pass-through opening 18. A fourth sensor is cable sensor 64 shown fastened to the screen fence 40; in the embodiment shown, lengths of such cable are shown running horizontally along a length of the screen fence 40 and at three different elevations off of the ground 16. A fifth sensor 66' and multiple instances of a single sixth sensor 66 are seismic sensors. The seismic sensor 66' is shown attached to a cross-buck 24 holding it above and off of the ground surface 16. The seismic sensors 66 are actually underneath the ground surface 16, but in this view they are each represented with by a circle on the ground surface 16 in order to mark their general locations. A seventh sensor is a camera 68 supported above the barrier by a tower structure 82. The tower structure 82 may be physically attacked to the barrier 10, for example near the tower base 84. An eighth sensor is a weather sensor 70 mounted to a tower-top mounting unit 80. A ninth sensor is a tower sensor 72 that is also mounted to the tower-top mounting unit 80. A tenth sensor is a barrier continuity sensor 90 (not shown here, but is shown in FIG. 3) that would for example be mounted inside of one of the generally horizontal beams, for example the primary beam 22 or the secondary beam 30.

FIG. 1 provides a reference for discussion regarding how some sensors are mounted to some structures in this and some other of the possible embodiments of the current invention(s). It is an aspect of the current invention(s) that at least some of the sensors should not be used solely as islands of disturbance detection. By that is meant that the present invention(s) make opportunistic use of collections of sensors, some of the same type and/or some of different types, in order to discriminate actual intrusion activities from causes of what could otherwise result in nuisance alarms or in false alarms. This is accomplished by employing sensor mounting structures that facilitate the ability of the sensors to respond to disturbances to which they might not otherwise respond. For example, if a cable sensor 64 was on a fence not attached mechanically to cross-bucks 24 holding a primary beam 22, then it most probably would not respond to disturbances made to the primary beam 22. Similarly, if the primary beam 22 was not connected in some way structurally to the fence that holds a cable sensor 64, then disturbances to the primary beam 22, sensed by the vibration sensor 50 mounted to the primary beam 22, would most likely not be sensed by the cable sensor 64. By mechanically interconnecting the various sensors by way of their mounting structures, more of the sensors can be responsive to a particular intrusion activity. More is said on this topic in the paragraphs below that discuss the use of machine learning engines, such as artificial neural networks, to transform multiple sensor signals (analog and/or digital) into meaningful alarms. But before proceeding to descriptions of the later figures, note that all of the sensors described for the embodiment 10 shown in FIG. 1, with the exception of the seismic sensors 66 that are underground, are interconnected by way of the barrier structures and their appendages. The attachment of the tower structure 82 to the rest of the barrier 10 is better shown in FIG. 2.

Figure 2:
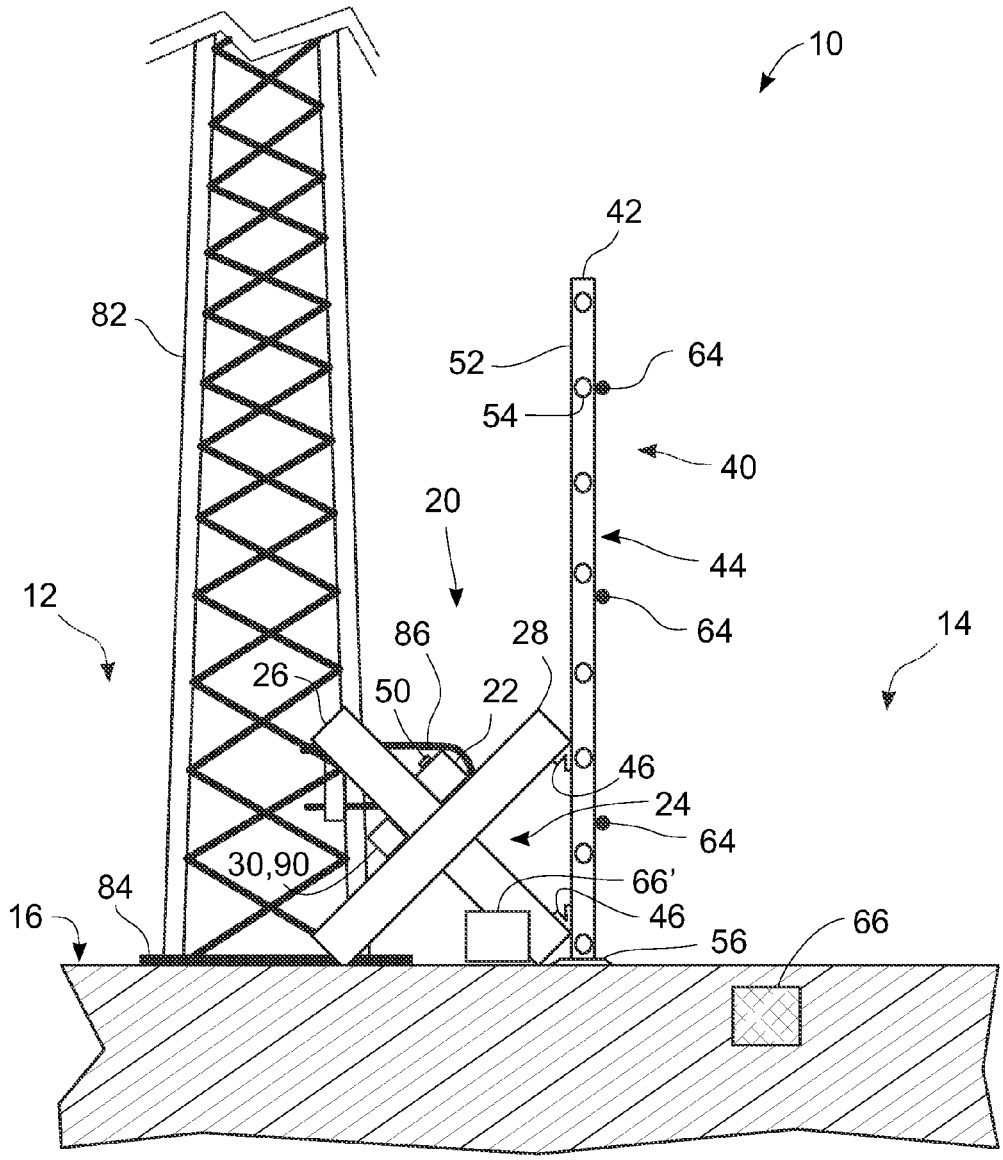
FIG. 2 shows a side view of the portion of barrier shown in FIG. 1 and includes a vertical cross-section taken through the pass-through opening and the ground, revealing a buried seismic sensor.

FIG. 2 shows a side view of the portion of barrier 10 shown in FIG. 1 and includes a vertical cross-section taken through the pass-through opening 18 and the ground beneath the ground surface 16, revealing a seismic sensor 66 buried in the ground. This view more clearly shows the relationship of the tower structure 82 to the rest of the structures. A tower fastener 86 is shown which attaches the tower structure 82 to the primary beam 22. In this embodiment, the tower base 84 is shown to be a steel plate but can be of other forms. Also, screen fence holders 46 are shown fastened at the top of the forward leaning beam 28 and bottom of back-leaning beam 26 of a cross-buck 24 where they fasten the cross-buck 24 to the fence support post 42, and holding the post 42 on or above the ground surface 16. In this view, the bridge sensor 56 is obstructing a view of the bottom of the fence support post 42. Other items shown have the same callouts as in FIG. 1.

Figure 3:
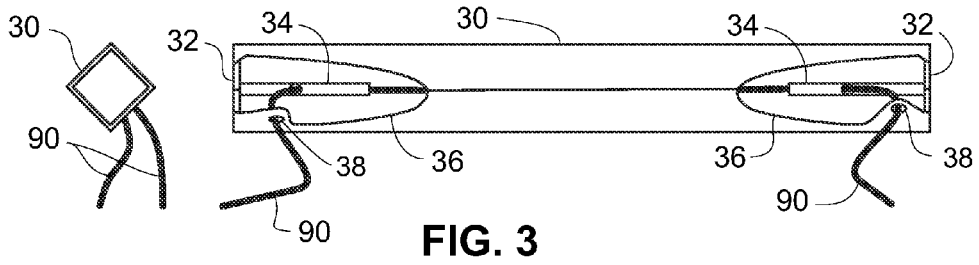
FIG. 3 shows a portion of a barrier-continuity sensor mounted within a channel.

FIG. 3 shows both an end view and a frontal view of a portion of a barrier-continuity sensor 90 mounted within a channel within the secondary beam 30. In this embodiment, the barrier continuity sensor 90 is a cable such as a fiber-optic cable, and it is shown entering and exiting the secondary beam 30 through holes 38 located near the left and right ends of the secondary beam 30 as oriented in this view. Sections 36 of the secondary beam 30 are cut-away in this view only in order to show details of how the barrier-continuity sensor 90 is mounted within and to the opposite ends (left and right hand ends in this view) of the secondary beam 30. The cable of the barrier-continuity sensor 90 is held to end-caps 32 of the secondary beam 30 by means of cable fasteners 34. Any intrusion attempt that severs or bends the secondary beam will cause a detectable disturbance or interruption of the communication carried by the cable of the barrier continuity sensor 90.

Figure 4:
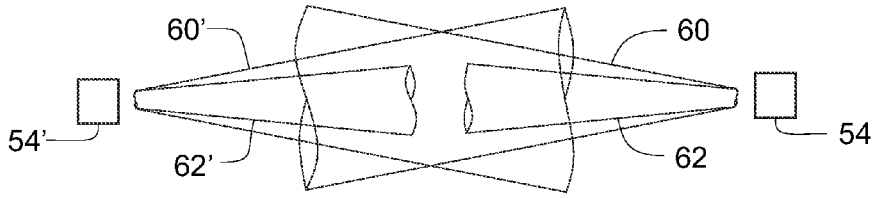
Figure 6:
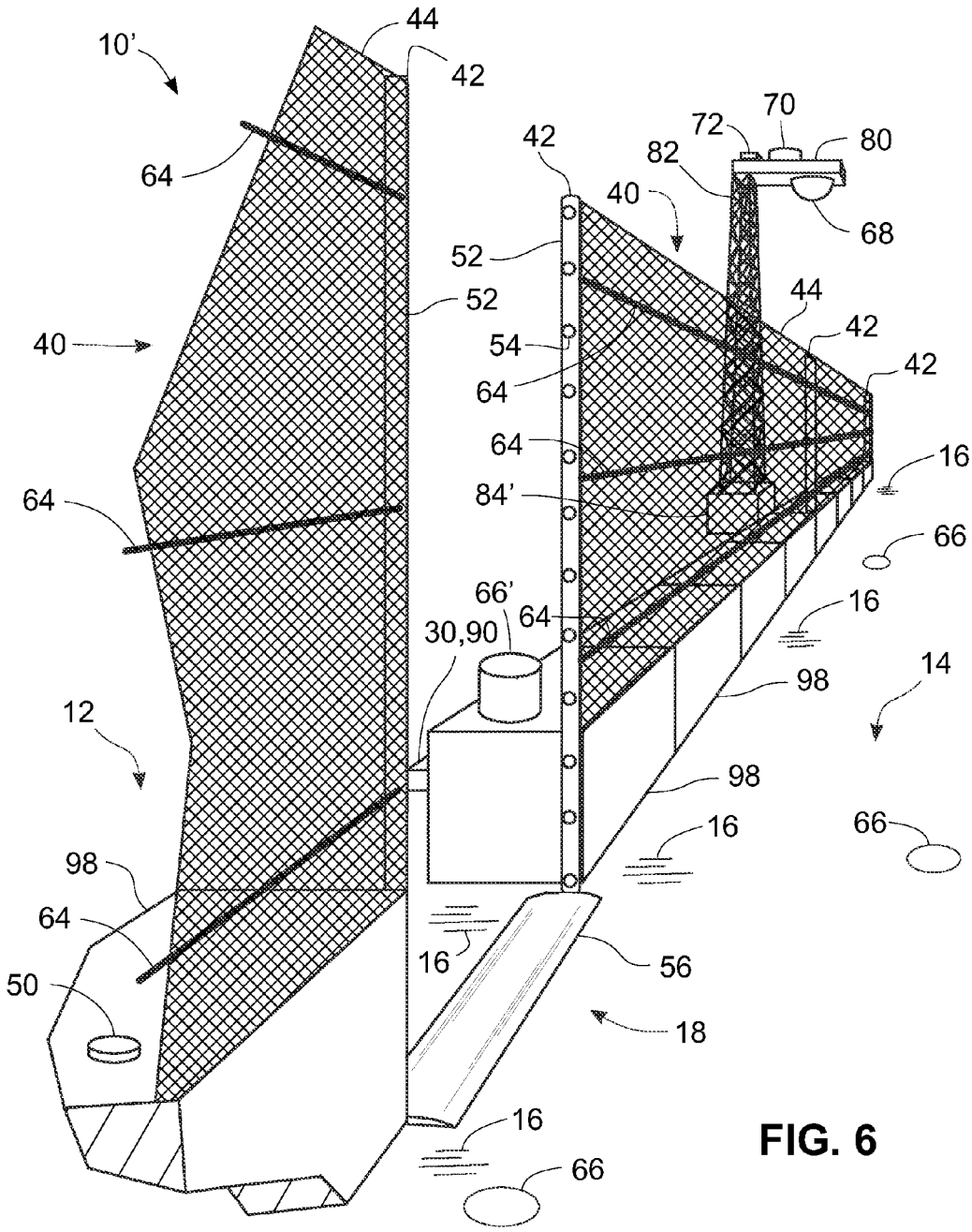
FIG. 6 shows a perspective view of a portion of a second embodiment of an intrusion delaying barrier equipped with a variety of sensors and revealing a pass-through opening.
Figure 7:
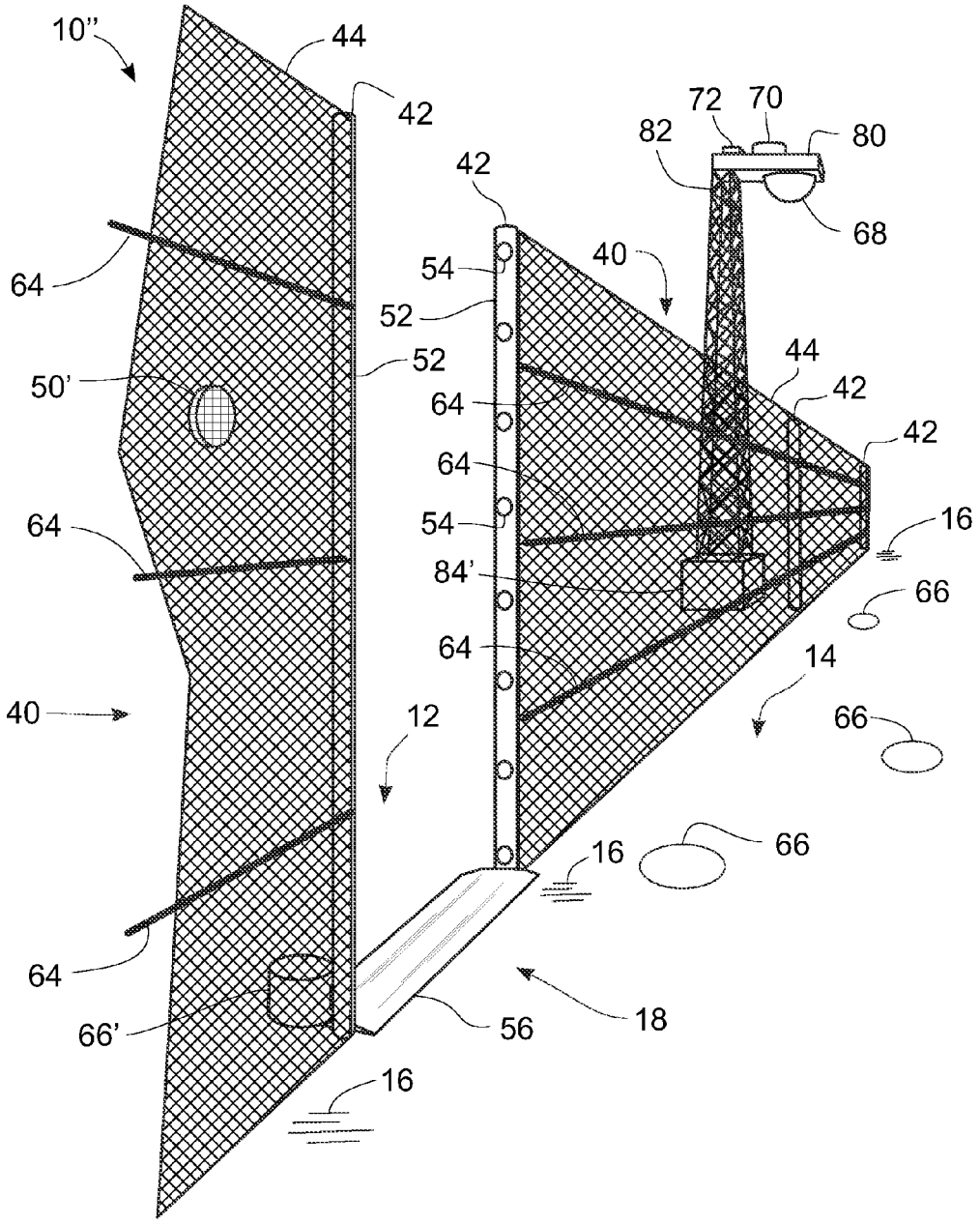
FIG. 7 shows a perspective view of a portion of a third embodiment of an intrusion delaying barrier equipped with a variety of sensors and revealing a pass-through opening.

FIG. 4 shows overlapping fields-of-illumination 62 and fields-of-view 60 associated with photon sensors 54 and 54' (associated with their emitters and receivers) as used on the photon bar sensor 52 shown in FIGS. 1 and 2 (and the oppositely facing photon bar sensors 52 shown in FIGS. 6 and 7). By mounting the photon sensor bars 52 directly the support posts 42 of the screen fence 40, the photon sensors 54 can respond not only to objects passing through the pass-through opening 18, but also to disturbances to the screen fence 40 and other barrier disturbances, and this can be exploited in the present invention(s) as discussed further in sections below.

Figure 5:
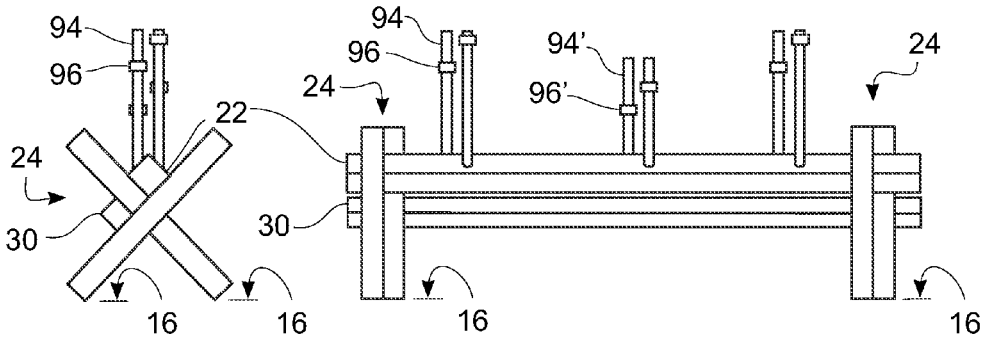
FIG. 5 shows both a frontal and end view of a section or module of cross-buck-supported barrier beams, and shows optional roll bars holding optional roll-bar-mounted sensors not shown in the previous figures.

FIG. 5 shows both a frontal and an end view of a section or module of a Normandy type of barrier consisting of cross-buck-supported barrier beams (cross-bucks 24) supporting a primary beam 22 and a secondary beam 30). Optional roll bars 94 holding optional roll-bar-mounted sensors 96 (not shown in the previous figures) are shown as a modification. The roll bars 94 help to prevent rolling of the barrier if the barrier is stuck by a vehicle. Being cantilevers extending from the primary beam 22, the roll bars are subject to vibrations whenever the barrier, or other things attached to the barrier, is disturbed. Thus the roll-bar-mounted sensors 96 can be responsive to a wide variety of barrier disturbances, and this can be exploited in the present invention(s) as discussed further in sections below.

FIG. 6 shows a perspective view of a portion of a second embodiment of an intrusion delaying barrier 10' equipped with a variety of sensors 50, 52, 54, 56, 64, 66, 66', 68, 70, 72, and 90 and revealing a pass-through opening 18. In this view which is somewhat similar to the perspective view in FIG. 1 of a portion of the first embodiment of an intrusion delaying barrier 10, both sides of the pass-through opening 18 are visible. A photon bar sensor 52 is indicated along each of the two fence support posts 42 that border the pass-through opening 18. In this second embodiment, the Normandy type barrier of the first implementation shown in FIG. 1 is replaced by a row of concrete barrier blocks 98 such as, for examples, those disclosed in U.S. Pat. Nos. 7,144,186; 7,144,187; 7,654,768; and 8,061,930; wherein the blocks are bound to one-another by means of interconnected steel bars or even by one or more cable(s) or chain(s). The barrier continuity sensor 90 is protected inside of the secondary beam 30 (as shown in FIG. 3) which, in this second embodiment 10', is attached, for example, to the row of the blocks 98. The seismic sensor 66' is attached, for example, to the top of one of the barrier blocks 98, whereas other seismic sensors 66 are buried under the ground 16 at locations indicated in the unprotected area 14. The screen fence 40 is mounted, at least by way of its support posts 42, to the row of barrier blocks 98 and not into the ground 16. The tower base 84' in this embodiment is a concrete block, and the tower base 84' or tower structure 82 may or may not be mechanically tied to the row of blocks 98, for example by way of a tie-bar (not shown) attached to and extending between the row of blocks 98 and either the tower base 84' or the tower structure 82.

FIG. 7 shows a perspective view of a portion of a third embodiment of an intrusion delaying barrier 10" equipped with a variety of sensors 50', 52, 54, 56, 64, 66, 66', 68, 70, and 72, and revealing a pass-through opening 18. Unlike the first and second embodiments 10 and 10', this third embodiment of an intrusion delaying barrier 10" has a screen fence mounted by support posts 42 into the ground 16 rather than being mounted instead to an accompanying Normandy type of barrier or row of concrete blocks. There is no barrier continuity sensor 90. The seismic sensor 66' is shown mounted to the base of the support pole 42. A vibration sensor 50' is mounted to the screen 44 of the screen fence 40. The tower base 84' is concrete, and the tower structure 82 or tower base 84 may or may not be connected directly to the screen fence 40, as for example by means of a tie-bar (not shown). This embodiment is less expensive than the previously described embodiments, but it lacks the added physical protection of a harder barrier structure; however this embodiment does still afford having multiple sensors and multiple types of sensors all interconnected structurally.

Figure 8:
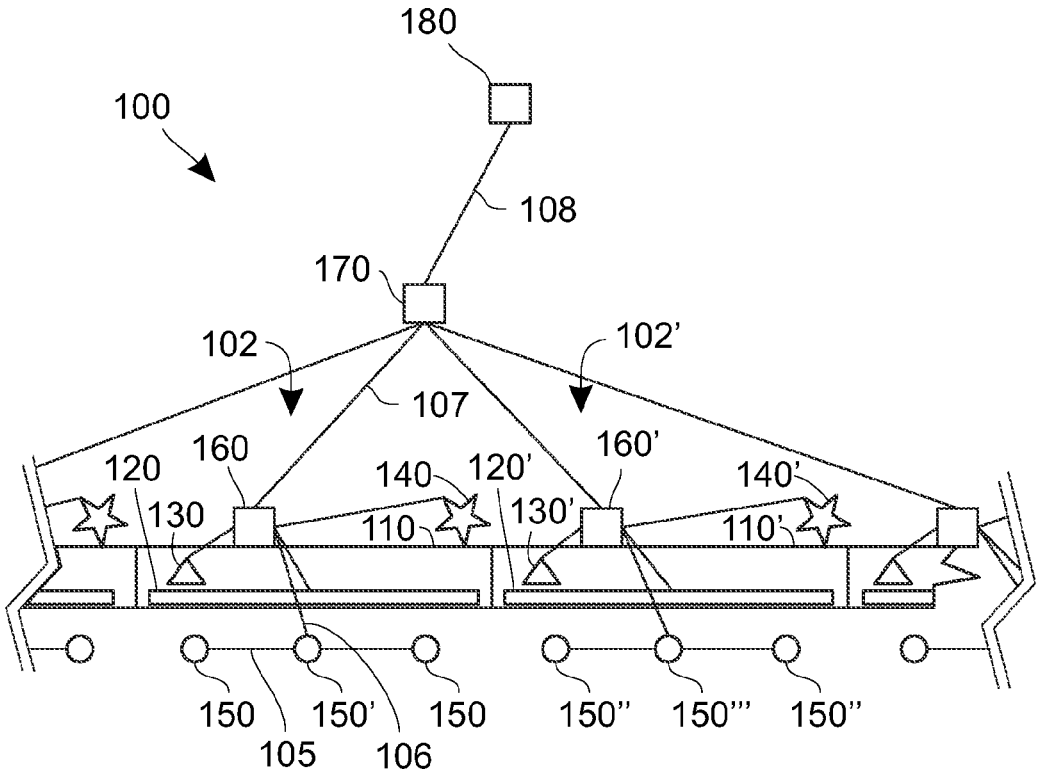
FIG. 8 shows a diagram depicting neighboring sections of intrusion delaying barrier with a variety of sensors associated with each section connected respectively to a computer at each section, wherein the computers at the sections are connected to another computer remote from the barrier.

FIG. 8 shows a diagram 100 depicting sensors and computers of neighboring sections 102 and 102' of intrusion delaying barrier according to at least one implementation of the current invention(s). The physical sections 110 and 110' of sections 102 and 102' are shown joined to one another forming a barrier row. Sensors 120, 130, 140, 150 (two instances), and 150' are shown associated with the physical section 110; sensors 120, 130, 140, and 150' are electronically linked to a computer 160 on the physical section 110 (e.g. each by a link 106 such as shown between sensor 150' and computer 160). Sensors 150 (two instances) are electronically linked to sensor 150' by a link such as link 105. Similarly: sensors 120', 130', 140', 150" (two instances), and 150'" are shown associated with the physical section 110'; sensors 120', 130', 140', and 150'" are electronically linked to a computer 160' on the physical section 110'; sensors 150" (two instances) are electronically linked to sensor 150'". The computers 160 and 160' are in turn electronically linked to another computer 170 remote from computers 160 and 160' (e.g. by link 107 between computer 160 and computer 170). The remote computer 170 is shown optionally linked electronically (e.g. by link 108) to at least one other computer or alarm device or alarm annunciator 180. The straight lines in the diagram representing electronic links between sensors, between sensors and computers, and from one computer to another, represent any imaginable means of communication that one skilled in the art might choose to implement for this context, such as by use of communication cables, radio links, and/or the Internet. The computers 160 and 160' could also be connected to communicate with one another. The ends of outwardly adjacent sections of the common barrier row are also shown on the left and right hand ends of the joined two sections 102 and 102' combination. The physical sections 110 and 110' of sections 102 and 102' can, for example, be representative of those shown in FIGS. 1, 2, 6, and 7; and the sensors of FIG. 8 can be representative of sensors shown in those same figures. In FIGS. 1, 2, 6, and 7, the computers 160, 160', 170, and optionally 180 are hidden from view along with power devices and any cabling for communication between the sensors and computers.

Figure 9:
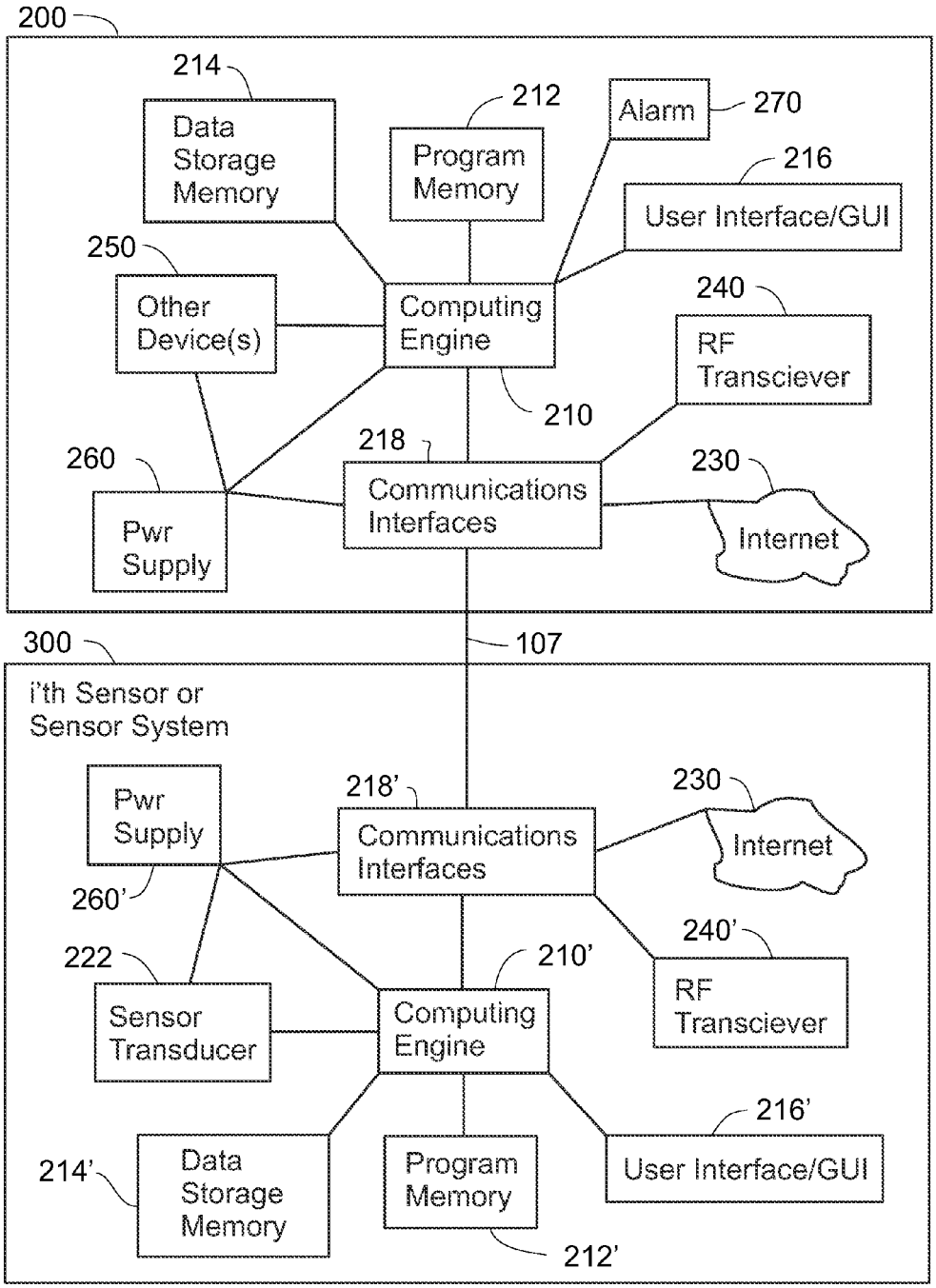
FIG. 9 shows a diagram of an embodiment of a sensor subsystem connected to another computer.

FIG. 9 shows one embodiment of a sensor subsystem 300 that communicates with a computer 200. In some implementations of the current invention(s), any of the sensors described in the previous figures could be configured as sensor subsystem 300. And in some implementations of the current invention(s), any of the computers 160, 160', 170, and 180 of FIG. 8 can be configured as computer 200. In one implementation of the invention(s), sensor subsystem 300 is computer 160 as shown in FIG. 8, computer 200 is computer 170 as shown in FIG. 8, and the link between them is electronic link 107 also shown in FIG. 8. But depending upon the implementation, the electronic link between sensor subsystem 300 and computer 200 can be any of the links 105-108 shown in FIG. 8. Both the sensor subsystem 300 and the computer 200 are shown with connections to the Internet 230 and/or radio communication equipment 240, but this is optional and may not be needed in many embodiments. Power supplies 260 and 260' are shown, showing their connections to some of the components, but it should be understood by those skilled in the art that this is not meant to limit the embodiments of the present invention(s) since power and its routing to components within the computer 200 and sensor subsystem 300 can be accomplished in many ways not shown. The computer 200 includes a computer processor shown as computer engine 210. Connected to the computer engine 210 may be program memory 212, data storage memory 214, a user interface 216, one or more communications interfaces 218, a connection to the Internet 230, an RF transceiver 240, other devices 250, and at least one connection to at least one alarm 270. This alarm 270 is meant to represent either an actual alarm device or simply a memory device maintaining one or more alarm status indicator values, wherein such a memory device can, for example, be part of data storage memory 214 or a memory register of the computing engine 210. As computer 200 represents a general purpose computer, nothing in this block diagram should be taken to limit the computer architecture or function of computers used to generate alarm signals or alarm status values in the current invention(s). Some embodiments of the current invention(s) can store one or more machine learning algorithms in the program memory 212 for execution by the computer engine 210 to maintain at least one alarm status indicator value in the data storage memory, and to generate signals to the alarm 270 based on results of a pattern detection and/or recognition results discovered within data received from one or more sensors such as the sensor subsystem 300. The signals sent to the alarm 270 would relate to the presence or absence of intrusion activities on a barrier as sensed by the sensor subsystem(s) 300.

Within FIG. 9, the sensor subsystem 300 represents only one possible configuration for a sensor subsystem or sensor. What is shown is a general purpose computing apparatus. One skilled in the art can understand the generalities of what is shown in FIG. 9, and that sensors and computer embodiments of the current invention(s) aren't intended to be limited by what is shown in FIG. 9. Regarding the sensor subsystem 300 shown, in some embodiments the sensor transducer 222 might represent multiple sensor transducers. A user interface 216' might or might not be used or incorporated. Some sensor transducers might be connected directly to another computer (such as the computer 200) making all of the parts shown in the sensor subsystem 300 unnecessary other than the sensor transducer 222 itself.

Figure 10:
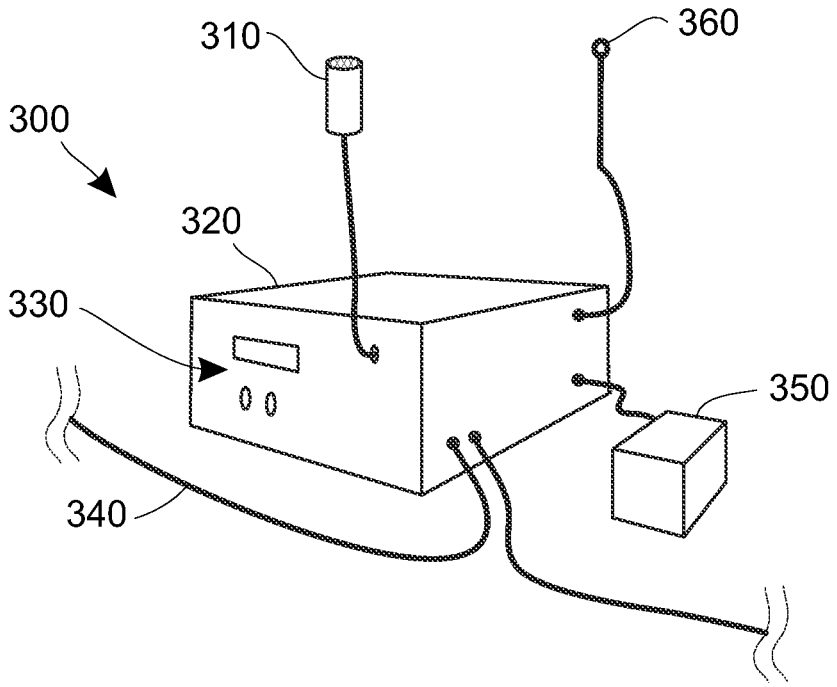
FIG. 10 shows a pictorial depiction of a computerized sensor subsystem.

FIG. 10 shows a pictorial depiction of the computerized sensor subsystem 300 diagramed within FIG. 9. Added in this view are an enclosure 320 for most of the sensor subsystem's components, a power supply enclosure 350, an RF antenna 360, a sensor transducer module 310, a display and control devices of a human interface 330, and communications cabling 340. Whereas what is depicted here is very generic, it is not to be taken as limiting the forms and functions of actual sensors and sensor subsystems as can be used in embodiments of the current invention(s).

Figure 11:
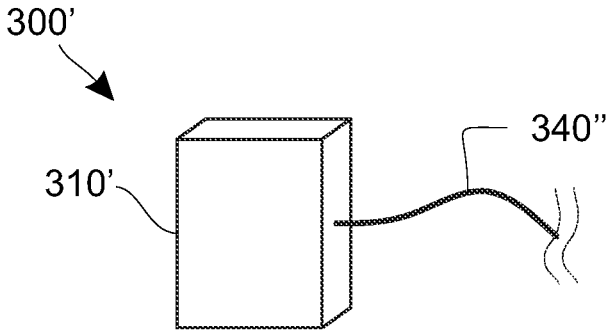
FIG. 11 shows a pictorial depiction of a compact embodiment of a sensor transducer or of a sensor subsystem.

FIG. 11 shows a pictorial depiction of a compact embodiment 300' of a sensor transducer or sensor subsystem 310'. What is shown is a sensor module 310' with a portion of its communications cable or other connection medium 340' extending out of a side of the module 310'. The medium 340' could represent a wireless link to a remote receiver or transceiver.

Figure 12:
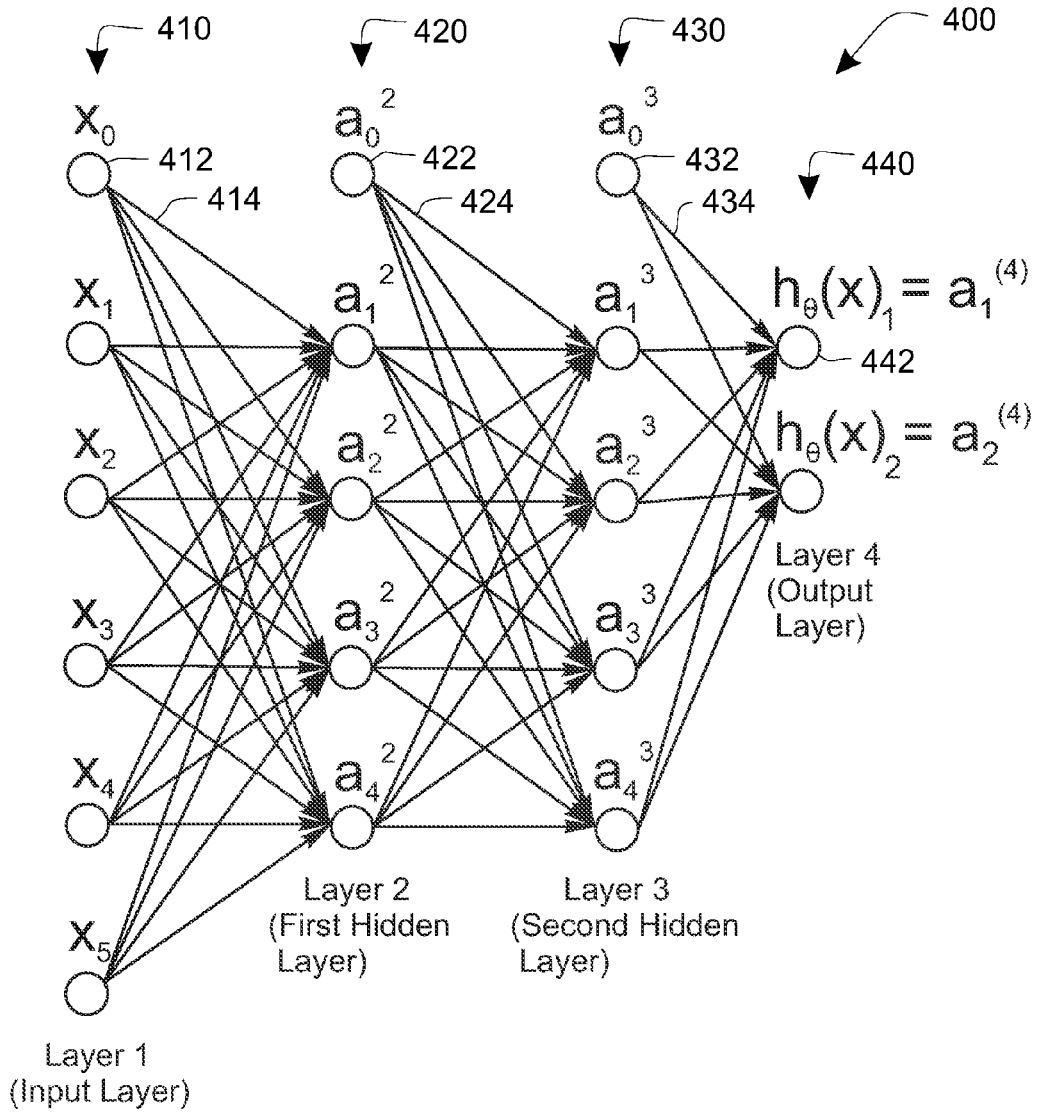
FIG. 12 shows a representation of an embodiment of an artificial neural network.

FIG. 12 shows one representation of one embodiment of one form of learning machine that might be practiced in implementing some of the embodiments of the current invention(s). Such learning machines would be processed by any of the computers 200 or 300, or any of the computing engines 210 or 210', shown in FIG. 9, which is to say they could be processed by any of the computers 160, 160', 170, and/or 180 shown in FIG. 8. What is shown in FIG. 12 is an example of an artificial neural network 400) having a particular structure, but other structures would also fall within the scope of the current invention(s) and claims. These other structures might, for example, have fewer or more inputs and/or outputs, fewer or more nodes within the hidden layers, and/or recurrent connections. This artificial neural network 400 has four layers 410, 420, 430, and 440 shown in four respective columns arranged from left to right respectively. At "layer 1" 410, the input layer, there are six input values $x_0$ through $x_5$, where $x_0$ at the top row of its column represents an input value that has a constant value of unity. Inputs $x_1$ through $x_5$ represent input values from sensors and are ordered sequentially down the column into lower row positions. These input values $x_1$ through $x_5$ may include data samples taken at different times from a single sensor, samples taken from multiple sensors taken at the same time, samples taken from different types of sensors, and/or samples taken from multiple sensors that are of the same type. In "layer 2" 420 (first hidden layer), there are five nodes (simulated neurons) that output activation values $a^2_0$ through $a^2_4$, where $a^2_0$ represents an output value of unity. In "layer 3" 430 (second hidden layer), there are five nodes (simulated neurons) that output activation values $a^3_0$ through $a^3_4$, where $a^3_0$ represents an output value of unity. In "layer 4" 440 (output layer), there are two output nodes (simulated neurons) that output activation values $a^4$, and $a^4_2$ which are also called $h_\theta(x)_1$ and $h_\theta(x)_2$ respectively, where the "h" stands for "hypothesis value". As we will see in the descriptions of FIGS. 13 and 15 below, the theta subscripts mean that the hypothesis values, i.e. the output values of the network, are a function of a matrix of theta values representing parameters learned by the network. As with layer 1 for input values, the activation values of the "neurons" in the other layers are all arranged in each column such that their subscript index values increase with each lower row position relative to the top of the respective column. Such arrangement, we will recognize in FIG. 15, is convenient for arranging matrices and vectors of these values for use in the linear algebra used for efficient representation of the mathematics involved in an artificial neural network. Note that the superscripts to the activation symbols denote the number of the layer they are in. Some embodiments of the current invention(s) can employ artificial neural networks, and these artificial neural networks are processed on computers such as those within the computer engines 210 and/or 210' shown in FIG. 9. Also shown in FIG. 12 are lines connecting each node in each column to all of the nodes in the subsequent layer with the exception of those having zero-subscripted activation values (those with a constant unity output value). To avoid cluttering the diagram further with callout numbers, callouts to the nodes and lines interconnecting the nodes of adjacent columns are reduced to just those to the nodes 412, 422, 432, and 442 at the tops of each column respectively, and to just the interconnection lines 414, 424, 434 that interconnect the top most nodes from one column to the next respectively, going from the first layer to the fourth layer.

Figures 13, 14:
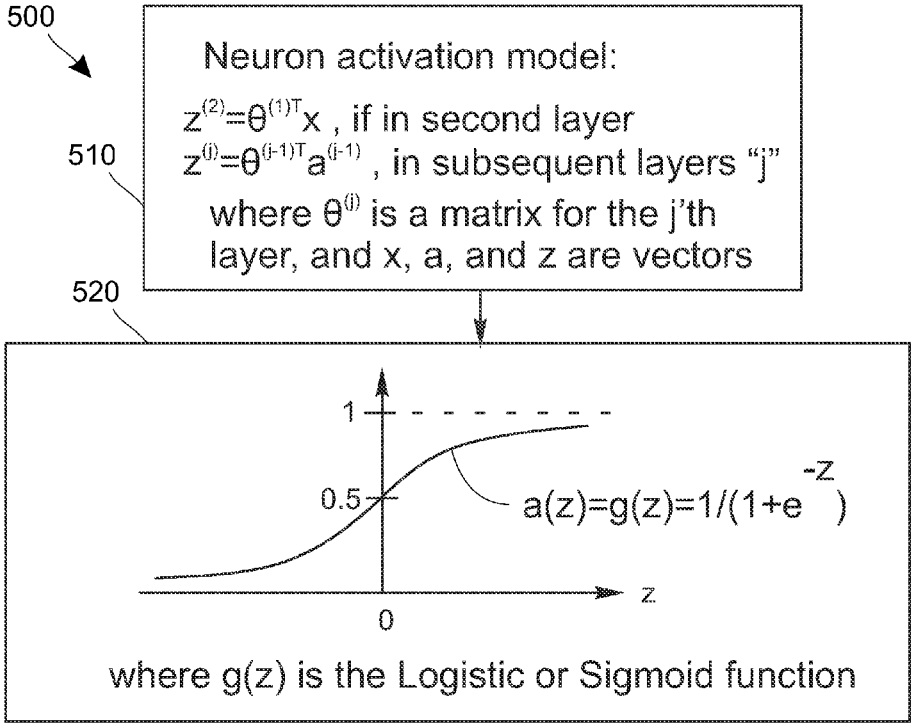
FIG. 13 shows a two-step process 500 embodiment of simulating neuron activation.
FIG. 14 shows an embodiment of a cost function for an artificial neural network.

FIG. 13 shows a two-step process embodiment 500 of simulating neuron activation in each layer of an artificial neural network. In the first step 510 and for the second layer, variable "$z^{(2)}$" is a vector of values calculated as the product of the transpose of a matrix $\theta^{(1)}$ of parameter values for the first layer and a vector "x" of input values. The symbol "T" in the figure stands for the transpose operator. In the first step 510 and for the subsequent j'th layers, variable)"$z^{(j)}$" is a vector of values calculated as the product of the transpose of a matrix $\theta^{(j-1)}$ of parameter values for the "j−1"th layer and a vector "$a^{(j-1)}$" of activation values of that preceding layer (i.e. of the "j−1"th layer). In the second step 520, activation values a(z) are calculated as a function of z using the logistic function g(z) which is also called a sigmoid function. One skilled in the art of artificial neural networks will recognize that other choices exist for activation functions without deviating from the scope of the current invention(s).

FIG. 14 shows an embodiment 550 of a cost function for an artificial neural network, and it will be familiar to those skilled in the art of artificial neural networks. It represents the error of an artificial neural network computed on a set of test data $x^{(m)}$, where there are M vectors or sets of sensor input data for which a true classification result $y^{(m)}$ is known for each vector $x^{(m)}$, where the value of the index m runs from 1 to M. The cost function of this embodiment is the function $J(\theta)$, and its first of two terms is computed as an arithmetic average taken over the M input vectors $x^{(m)}$ of the test set, where each vector corresponds to a single set of sensor samples. What is being averaged is a sum taken over the K activations of K neurons at the output of the network having K outputs. The sum is of a function of the actual outputs $h_\theta(x^{(m)})_k$ and the known true classification values $y_k^{(m)}$ recorded for the test data. The second term of the cost function is a regularization term used to control overfitting the data according to the value selected for the positive-valued parameter $\lambda$. Each quantity $\theta_{ij}^{(l)}$ is the weighting parameter used to calculate an activation value (see FIGS. 13 and 15) for the j'th neuron (or node) in the (l+1)'th layer from the i'th neuron in the l'th layer. As one skilled in the art of artificial neural networks will understand, it is by obtaining optimal values for these elements of the $\theta$ matrix that a minimum can be obtained for the cost value $J(\theta)$, thereby enabling the output(s) $h_\theta(x)$ of an artificial neural network to match as many correct classification values as possible given the quality of the test data used to find the best values for $\theta$.

FIG. 15 shows more detail of the first of the two steps shown in FIG. 13 used in computations of simulated neuron activations. Equation 600 expresses multiplication of the vector of x input values (sensor output values) by the transpose of the theta matrix for theta values going from the first layer to the second layer. Equation 610 expresses multiplication of the vector of $a^2$ activation values from the second layer by the transpose of the theta matrix for theta values going from the second layer to the third layer. Equation 620 expresses multiplication of the vector of $a^3$ activation values from the third layer by the transpose of the theta matrix for theta values going from the third layer to the fourth and last layer, i.e. the output layer.

FIG. 16 shows some of the computational steps 700 used in an embodiment of backward propagation used to seek a minimum of the cost function shown in FIG. 14. In order to seek a minimum in $J(\theta)$, its derivatives with respect to the theta values are used. The formulae used to calculate these derivatives are given in this figure and should be familiar to those skilled in the art of artificial neural nets and the use of backward propagation and gradient descent methods. One such method is described in the next paragraph describing FIG. 17.

Figure 17:
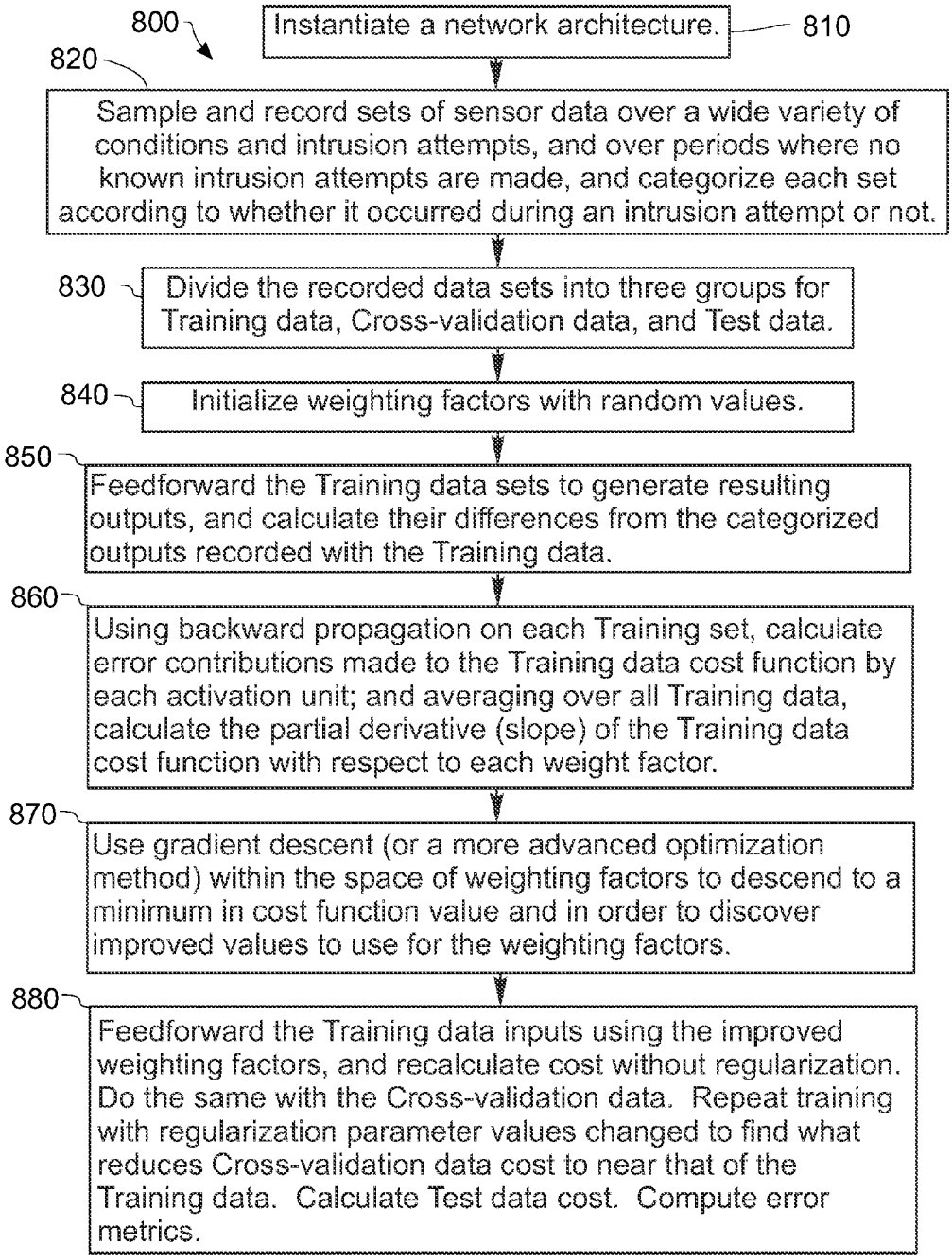
FIG. 17 shows steps in an embodiment of a method for creating and teaching an artificial neural net.

FIG. 17 shows steps 810, 820, 830, 840, 850, 860, 870, and 880 in an embodiment of a method 800 for creating and teaching an artificial neural net such as shown in FIG. 12. This method enables the finding of optimal values to use for the theta values of an artificial neural network such as used in some of the embodiments of the current invention(s). The result of applying the method is a set of theta values that perform optimally at least on the training and cross-validation data sets used in the training process. Desirable error metrics to compute for each output node or neuron include the following: Probability of detection $P_d$, Precision P, Recall R, and F1 score where F1=2PR/(P+R). Precision is calculated by dividing the number of input vectors that are classified correctly as positives by the number of input vectors that are classified correctly or incorrectly as positive. Recall is calculated by dividing the number of true positives by the number of input vectors that should have been classified as positive. One aspect of the current inventions is to have an additional method step that records true classification values $y_k^{(M+n)}$ obtained from human observations for n vectors of input sensor data $x^{(M+n)}$, where M+n represents an index value for data taken at least after the M vectors of training data. Using this additional data, the theta values of the network can be retrained with a larger and larger data set as more data is collected. As one skilled in the art of artificial neural networks understands, training an artificial neural network with a larger quantity of accurately classified input vectors will almost always generate more optimal values for theta (i.e. for the matrix $\theta$).

It is intended that one skilled in the art of artificial neural networks can readily envision fewer or more steps relative to those in the process 800 shown in FIG. 17, but it is intended that these modifications are within the scope of the present invention(s). The embodiments described and illustrated in this disclosure focus for simplicity on artificial neural networks, but it is also intended that any of the other techniques within the broader field of pattern detection and recognition known as learning machines could be used and still be within the scope of this disclosure and of the current invention(s). A particular example of one of these other techniques is the use of Support Vector Machines that use kernel functions (such as a Gaussian kernel, or even a sigmoid function, at feature points) to achieve the biggest possible distance margin between opposite classes within a high-dimension feature space. Although machine learning avoids explicit programming of expert knowledge and logic rules, some embodiments of the present invention(s) can utilize a hybrid collection and/or mixture of these other techniques. Furthermore, some embodiments of the present invention(s) can include more than a single artificial neural network or other learning machine. For example, some sensors that are used can have their own simulated artificial neural networks operating within their own sensor subsystems. And segments of barrier length can include one or more learning machines operating independently of other segments of barrier length. Furthermore, some embodiments of the present invention(s) can include remote access and adjustment of machine learning processes and/or learning results, as for example by way of a remote computer and one or more Internet connections between the remote computer and a security barrier, e.g. to an intrusion delaying barrier of the current invention(s).

Several embodiments are specifically illustrated and/or described herein, and these illustrations are not meant to be restrictive. It will be appreciated that modifications and variations, as well as combinations of the above embodiments, and other embodiments not specifically described herein, are covered by the above teachings and are within the scope of the appended claims without departing from the spirit and intended scope thereof. Any arrangement configured to achieve the same purpose may be substituted for the specific embodiments shown. Method steps described herein may be performed in alternative orders. Various embodiments of the invention include programs and/or program logic stored on non-transitory, tangible computer readable media of any kind (e.g. optical discs, magnetic discs, semiconductor memory). System structures and organizations described herein may be rearranged. Various embodiments of the invention can include interconnections of various types between various numbers of various subsystems and sub-components. The scope of various embodiments of the invention includes any other applications in which the above structures and methods are used.

We claim:

1. An intrusion delaying barrier comprising:

a. a primary structure selected from the group consisting of i) a steel beam supported by cross-bucks standing on top of the ground and ii) a row of concrete blocks sitting on top of the ground, wherein the row of concrete blocks is bound end-against-end by a chain of steel tie-bars; and b. a secondary structure selected from the group consisting of a chain link fence, a welded mesh fence, and a wire fence;

wherein a majority of weight of the secondary structure is supported by the primary structure; and wherein neither the primary structure nor the secondary structure is planted into the ground.

2. The intrusion delaying barrier of claim 1, wherein the steel beam supported by cross-bucks is comprised by a Normandy type barrier.

3. The intrusion delaying barrier of claim 1, further comprising:

c. multiple sensors;

d. multiple sensor support structures attached to the barrier;

e. an alarm status indicator; and f. a computer in communication with the multiple sensors and the alarm status indicator;

wherein the computer generates an output to the alarm status indicator when an intrusion attempt disturbs the barrier.

4. The intrusion delaying barrier of claim 3, wherein the computer simulates a first learning machine that takes as inputs data from two or more of the multiple sensors.

5. The intrusion delaying barrier of claim 4, further comprising: a second learning machine;

wherein the intrusion delaying barrier has a length axis that forms a dividing line between a more secure side and a less secure side;

wherein the first and second learning machines are connected to different groups of sensors of the multiple sensors; and wherein the first and second learning machines monitor primarily their respective segments along the length dimension.

6. The intrusion delaying barrier of claim 4, wherein the first learning machine includes one selected from the group consisting of an artificial neural network and a Support Vector Machine.

7. The intrusion delaying barrier of claim 4, wherein the first learning machine actively discriminates against nuisance conditions and/or against false alarm conditions.

8. The intrusion delaying barrier of claim 3, wherein a status of the alarm status indicator is controlled by the computer to be a function of degree of correlation among at least two of the multiple sensors in sensing at least the intrusion attempt; and wherein the degree of correlation is based on probabilities that disturbances to the sensors may be from the intrusion attempt.

9. The intrusion delaying barrier of claim 3, wherein the multiple sensors include at least three sensors that are each of a different type of sensor based on different transducer principles;

wherein status of the alarm status indicator is controlled by the computer to be a function of degree of correlation between at least two of the multiple sensors in sensing the intrusion attempt, and wherein the at least two of the multiple sensors are not of the same type of sensor.

10. The intrusion delaying barrier of claim 9, wherein the at least three sensors are supported structurally by the barrier by respectively different mounting devices selected from the group consisting of a fence, a wire, a cable, a conduit, a tube, a bar, a pole, a wall, a cantilever, a panel, a bridge, a tower, and a horizontal channel.

11. An intrusion delaying barrier comprising:

a. a contiguous series of interconnected steel beams that help to form a dividing line between a secure area of ground on one side of the beams and a less secure side on the other side of the beams;

b. multiple sensors;

c. multiple types of mechanical support structures each connecting one of the multiple sensors to the chain of interconnected steel beams;

d. an alarm status indicator; and e. a computer in communication with both the multiple sensors and the alarm status indicator;

wherein the multiple sensors include at least three different types of sensors based on different transducer principles; and wherein a status of the alarm status indicator is controlled by the computer to be a function of degree of correlation among at least two of the at least three different types of sensors in sensing at least an intrusion attempt.

12. The intrusion delaying barrier of claim 11, wherein the steel beams alone weigh at least fifteen kilograms per linear meter along the divide.

13. The intrusion delaying barrier of claim 11, wherein the steel beams are included in one selected from the group consisting of a Normandy type barrier and a row of concrete blocks, wherein the blocks are bound together by the steel beams.

14. The intrusion delaying barrier of claim 11, further comprising at least one mounting structure connected to the steel beams and comprises one selected from the group consisting of a fence, a wire, a cable, a conduit, a tube, a bar, a pole, a wall, a cantilever, a panel, a bridge, a tower, and a horizontal channel.

15. The intrusion delaying barrier of claim 11, wherein the degree of correlation is based on probabilities that disturbances to the sensors are caused by attempted intrusion.

16. The intrusion delaying barrier of claim 11, wherein the computer includes a first learning machine that takes as inputs data from the at least two of the at least three different types of sensors.

17. The intrusion delaying barrier of claim 16, wherein the first learning machine includes one selected from the group consisting of an artificial neural network and a Support Vector Machine.

18. The intrusion delaying barrier of claim 16, wherein the first learning machine actively discriminates against nuisance conditions and/or against false alarm conditions.

19. A method of configuring a security barrier, the security barrier comprising both a physical barrier to delay or stop intruders and a system of sensors useful to detect intrusion attempts, the method comprising steps of:

a. installing the physical barrier;

b. installing the sensors to the physical barrier;

c. installing communication media for communication between the sensors and an alarm annunciator;

d. installing additional communication media for communication between at least one computer and two or more of the sensors; and e. providing the at least one computer with instructions to execute a machine learning algorithm to transform sensor outputs into alarm outputs for the alarm annunciator;

wherein no concrete or steel element of the physical barrier is buried in the ground.

20. The method of claim 19, further comprising the step of using the security barrier to delay or stop intruders, or at least detect intrusion attempts by would-be intruders.

21. The method of claim 19, further comprising the step of remotely adjusting machine learning processes and/or learning results.

* * * * *